US012409395B2

(12) United States Patent
Wilson, IV et al.

(10) Patent No.: US 12,409,395 B2
(45) Date of Patent: Sep. 9, 2025

(54) CONSTRUCTION KIT AND COMPONENTS THEREOF

(71) Applicant: IDEA VAULT HOLDINGS INC., Ashland, OR (US)

(72) Inventors: Howard Allen Wilson, IV, Medford, OR (US); Michael E. Munter, Ashland, OR (US)

(73) Assignee: IDEA VAULT HOLDINGS INC, Ashland, OR (US)

( * ) Notice: Subject to any disclaimer, the term of this patent is extended or adjusted under 35 U.S.C. 154(b) by 170 days.

(21) Appl. No.: 18/045,808

(22) Filed: Oct. 11, 2022

(65) Prior Publication Data

US 2023/0114267 A1 Apr. 13, 2023

Related U.S. Application Data

(60) Provisional application No. 63/254,524, filed on Oct. 11, 2021.

(51) Int. Cl.

| | |
|---|---|
| ***A63H 33/08*** | (2006.01) |
| ***A63H 33/04*** | (2006.01) |
| ***A63H 33/06*** | (2006.01) |
| ***A63H 33/10*** | (2006.01) |

(52) U.S. Cl.

CPC ..... *A63H 33/044* (2013.01); *A63H 33/067* (2013.01); *A63H 33/088* (2013.01); *A63H 33/10* (2013.01); *A63H 33/106* (2013.01); *A63H 33/108* (2013.01)

(58) Field of Classification Search

CPC ..... A63H 33/067; A63H 33/088; A63H 33/106; A63H 33/108

See application file for complete search history.

(56) References Cited

U.S. PATENT DOCUMENTS

| | | | | |
|---|---|---|---|---|
| 2,803,088 | A * | 8/1957 | Swann | G09B 23/26 403/176 |
| 3,486,268 | A * | 12/1969 | Fischer | A63H 33/062 446/124 |
| 3,950,888 | A * | 4/1976 | Hogan | A63H 33/108 446/124 |
| 4,617,001 | A * | 10/1986 | Parein | A63H 33/105 59/900 |
| 4,627,210 | A | 12/1986 | Beaulieu | |
| 6,032,430 | A | 3/2000 | Soukup | |
| 6,626,727 | B2 * | 9/2003 | Balanchi | A63H 33/046 446/124 |

(Continued)

OTHER PUBLICATIONS

International Search Report and Written Opinion for corresponding International Application No. PCT/US2022/046336, mailed Jan. 25, 2023 (9 sheets).

*Primary Examiner* — John A Ricci

(74) *Attorney, Agent, or Firm* — Womble Bond Dickinson (US) LLP

(57) ABSTRACT

A construction kit enables building of complex structures. The kit can include pole connectors, along with a series of hubs. For instance, two-point hubs, four-point hubs, eight-point hubs, five-point hubs, six-point hubs, and a clip can be the constituent parts of the kit. Some of the hubs can be flexible to provide further utility and additional angles for building. Complex structures, such as a ball-shaped connector can also be achieved from the base components.

18 Claims, 28 Drawing Sheets

(56) References Cited

U.S. PATENT DOCUMENTS

| | | | | |
|---|---|---|---|---|
| 6,711,865 | B2 * | 3/2004 | Chaudoreille | F16B 12/2009 52/592.4 |
| 8,157,470 | B2 * | 4/2012 | De Wilde | F16B 12/10 403/348 |
| 10,661,192 | B2 * | 5/2020 | Moshfeghi-Nejad | A63H 33/088 |
| 2003/0005953 | A1 | 1/2003 | Erbetta et al. | |
| 2004/0253901 | A1 | 12/2004 | Donahue | |
| 2007/0051399 | A1 | 3/2007 | Jung | |
| 2009/0093182 | A1 | 4/2009 | Jacobs et al. | |
| 2013/0244530 | A1 * | 9/2013 | Renfro | A63H 33/088 446/124 |
| 2018/0243663 | A1 * | 8/2018 | Park | A63H 11/18 |

* cited by examiner

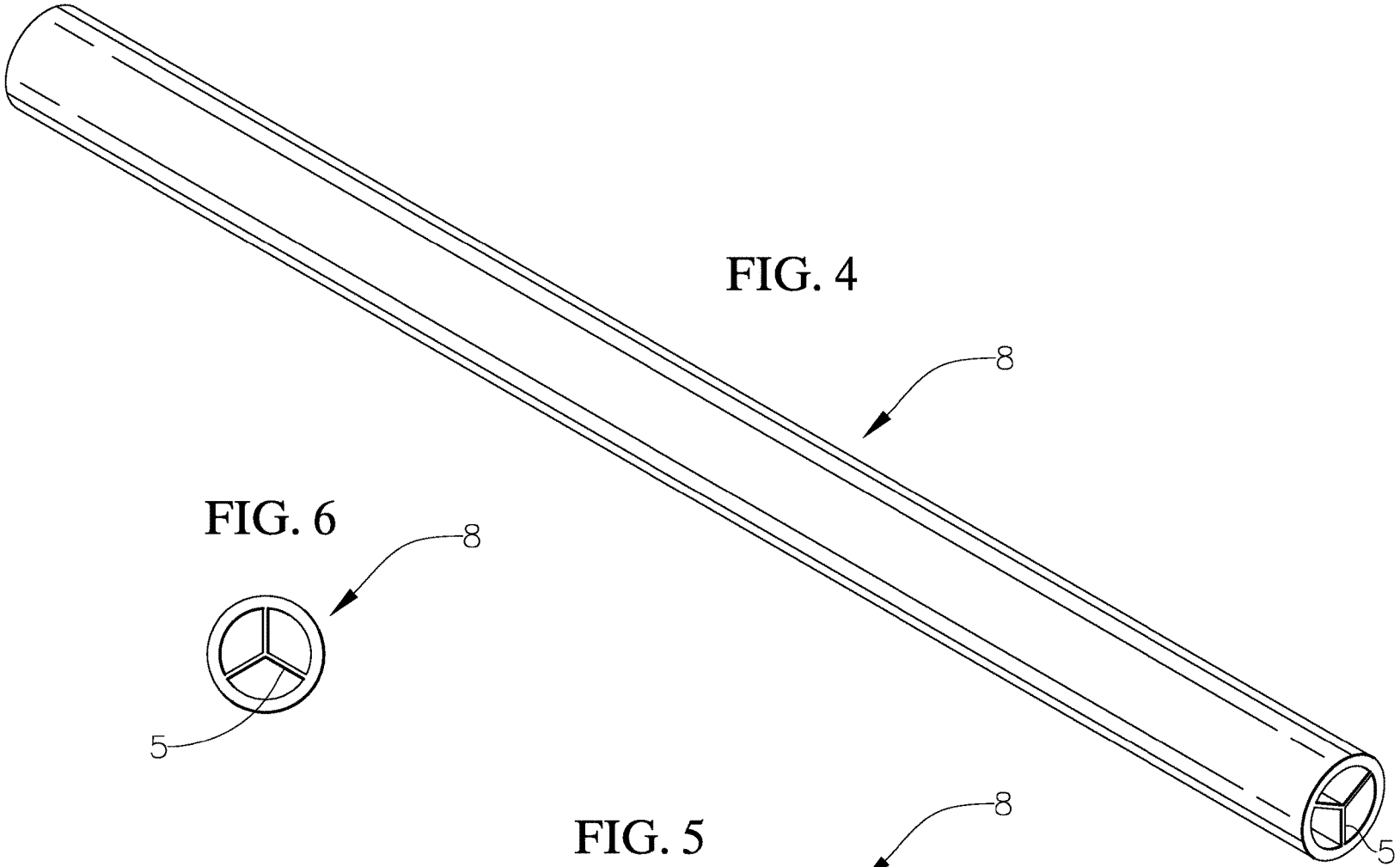
FIG. 4
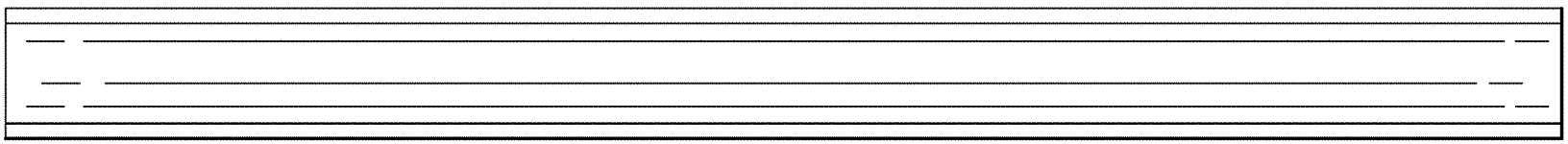
FIG. 5
FIG. 6

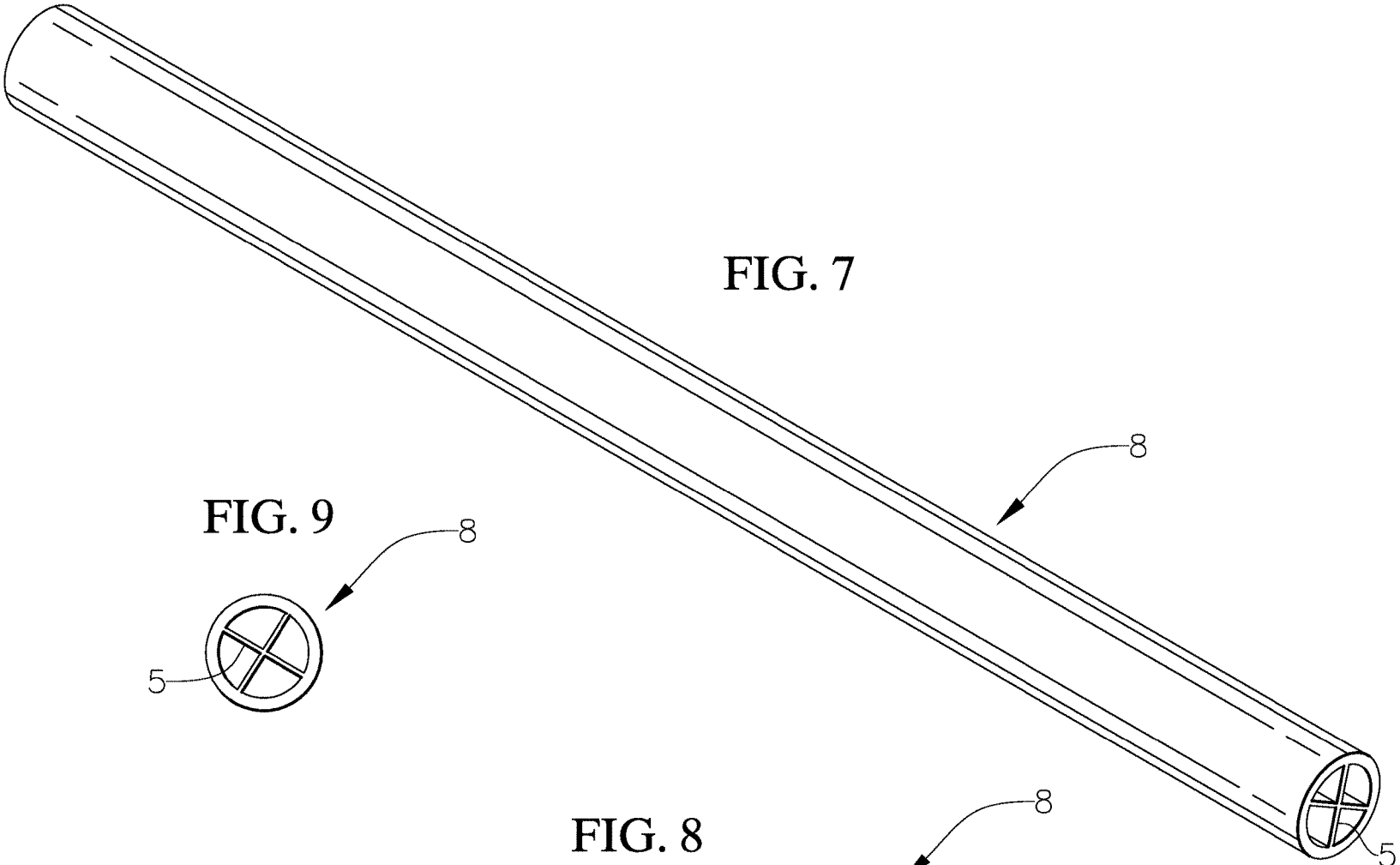
FIG. 7
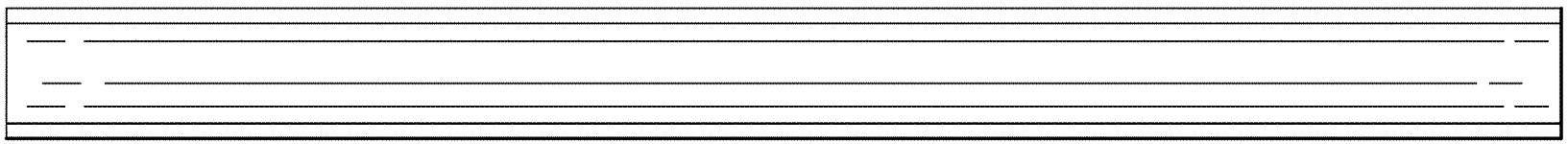
FIG. 8
FIG. 9

CONSTRUCTION KIT AND COMPONENTS THEREOF

CROSS-REFERENCE TO RELATED APPLICATION

This application claims priority to U.S. Provisional Patent Application Ser. No. 63/254,524 filed Oct. 11, 2021, the entire disclosure of which is incorporated herein by reference.

FIELD OF THE INVENTION

The present invention relates to construction kits and building toys, and, specifically, to connectors useful in fort-building kits.

BACKGROUND OF THE INVENTION

Toy construction kits are extremely popular and cover a wide gamut of different products. Children and/or hobbyists can construct a large variety of structures and models. Building bricks, notched sticks, magnetic connectors as well as more permanent arrangements involving adhesives are known in the art. However, these examples all face limitations based on their method of assembly. Frequently, the linkage of individual parts is limited to one or two configurations. As a result, the structures that can be built with such toys are often limited to arranging parts in parallel (i.e., linearly), and frequently the angles formed between individual parts are limited, sometimes only allowing for right angles.

SUMMARY OF THE INVENTION

The present invention involves a construction kit for building forts. In an embodiment, the basic components of kits made in accordance with an embodiment of the present invention include connector hub pieces ("hubs") and connecting poles ("poles"). The kit includes unique and versatile components enabling the assembly of a greater variety of constructed structures by giving the builder a large choice of options in terms of orientation of individual poles. Component parts with a large number of possible receiving ports offer additional flexibility both in terms of angles and the number of connectors that can be received at a single hub, leading to more complex building possibilities.

In a further embodiment, the kit features hubs that can connect with each other, essentially turning certain hubs into adapters for others. When operating as adapters, the combined hubs can interface with other kit components in modified configurations. These adapters can enable the receipt of further poles, allow for more choices of angles between poles, or expand a constructed structure.

A first component part of the present invention is an eight-sided hub. This piece includes a series of eight ports forming a ring around and circumscribing a pair of ports normal to the ring. In some embodiments the pair of ports have a dead-end construction, wherein each slot can individually receive a connector. In alternate embodiments, the two normal ports are interconnected, whereby they form a channel, enabling connector hubs or other pieces to pass through the channel, entering through one normal port and exiting out the other normal port. In such configurations, the eight-sided junction piece can receive connector hubs at eight different angles, or ten, if the normal ports are adapted to receive poles.

Connector poles serve to connect joint pieces (i.e., hubs) to one another. The poles can be substantially or completely linear, operating to visually define a constructed structure. In an embodiment, the connector poles can have one or more closed ends. Such closed ends would be compatible with the ports of the hubs and sized and shaped appropriately to fit loosely or securely in the ports. In alternate embodiments, the connector hubs have open ends. This could be an innocuous design choice, or, alternatively, the open ends can enable the poles to interface with an adapter, a retention device, etc.

Such adapters can fit loosely or securely in the connector hubs, using ridges, male-female connections, screw arrangements, etc. such that connections between the connector hubs and the joint pieces are made possible, or simply more secure. In other embodiments, two connector hubs can be connected via an adapter.

In additional embodiments a hub in the shape of a ring is provided. Eight ports are placed along the circumference of the ring. In the center of the ring, there is provided an opening through which a connector hub piece or other component can pass through. In an embodiment, a pole and/or hub can be threaded through the opening in the ring. In certain embodiments, there is a mechanism for securing an adapter in place. A snap-fit, magnetic connection or other reversible connection can be utilized. In an exemplary embodiment, the adapter can be rotated clockwise or counterclockwise when centered in the opening of the ring to lock in the adapter. The adapter and ring can be securely coupled to one another through slots and/or interfitting ridges, pieces etc. which can be aligned through rotation of the adapter member.

In an embodiment, one or more hemispherical hubs can be provided that function as adapters. For instance, a hemispherical adapter can have a central hemispherical port configured to receive one end of a hub. In one embodiment, the hemispherical adapter has additional ports, which can be used to receive poles at additional angles. In certain embodiments, with hemispherical adapters in place on both ends of the adapter, a compound ball structure can be formed. In an embodiment, a total of eighteen different angles can be achieved for interfacing connector poles with the ball structure. The ball structure itself can serve as a compound joint piece or hub.

An advantage of kits made in accordance with embodiments of the present invention is the ability to assemble compound hub structures based on the needs of the builder. For instance, the ball structure could be partially assembled and still function.

In an exemplary embodiment, a two-point hub can serve as the base of a compound hub. The two-point hub, in its simplest form, can receive two poles and operate as purely a joint between two collinear poles. If additional ports are required, an eight-point hub can be coupled to the two-point hub and locked in place as described hereinabove. This would allow for placement of poles eight additional directions perpendicular to the ports of the two-point hub. From there, if the builder wants to place additional poles, or orient the poles to extend at additional angles from the combination of the two and eight-point hubs, one or two four-point hubs can be attached to provide four and eight additional angles to poles, respectively, and/or form the compound ball structure.

BRIEF DESCRIPTION OF THE DRAWINGS

For a more complete understanding of the present invention, reference is made to the following detailed description of various exemplary embodiments considered in conjunction with the accompanying drawings, in which:

FIG. 4 is a perspective view of a pole connector in accordance with an embodiment of the present invention;

FIG. 5 is a front elevational view of the pole connector of FIG. 4;

FIG. 6 is a side elevational view of the pole connector of FIGS. 5 and 6;

FIG. 7 is a perspective view of a pole connector in accordance with an embodiment of the present invention;

FIG. 8 is a front elevational view of the pole connector of FIG. 7;

FIG. 9 is a side elevational view of the pole connector of FIGS. 7 and 8;

DETAILED DESCRIPTION OF THE EXEMPLARY EMBODIMENTS

The following disclosure is presented to provide an illustration of the general principles of the present invention and is not meant to limit, in any way, the inventive concepts contained herein. Moreover, the particular features described in this section can be used in combination with the other described features in each of the multitude of possible permutations and combinations contained herein.

All terms defined herein should be afforded their broadest possible interpretation, including any implied meanings as dictated by a reading of the specification as well as any words that a person having skill in the art and/or a dictionary, treatise, or similar authority would assign thereto.

Further, it should be noted that, as recited herein, the singular forms "a", "an", "the", and "one" include the plural referents unless otherwise stated. Additionally, the terms "comprises" and "comprising" when used herein specify that certain features are present in that embodiment; however, this phrase should not be interpreted to preclude the presence or addition of additional steps, operations, features, components, and/or groups thereof.

All examples and conditional language recited herein are intended for pedagogical purposes to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Reference will now be made to several embodiments of the present invention(s), examples of which are illustrated in the accompanying figures. Wherever practicable, similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

Figure 35:
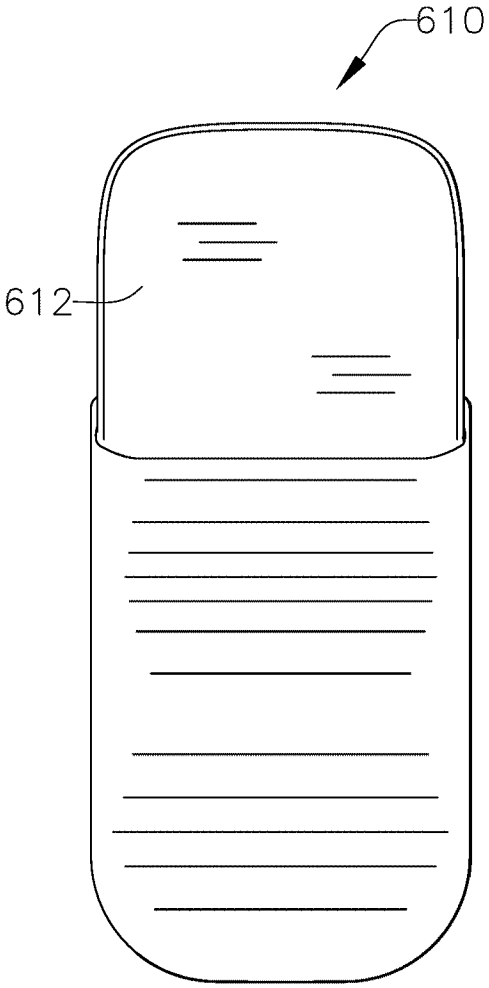
FIG. 35 is a side elevational view of a clip for ornamental pieces, in accordance with an embodiment of the present invention.
Figure 34:
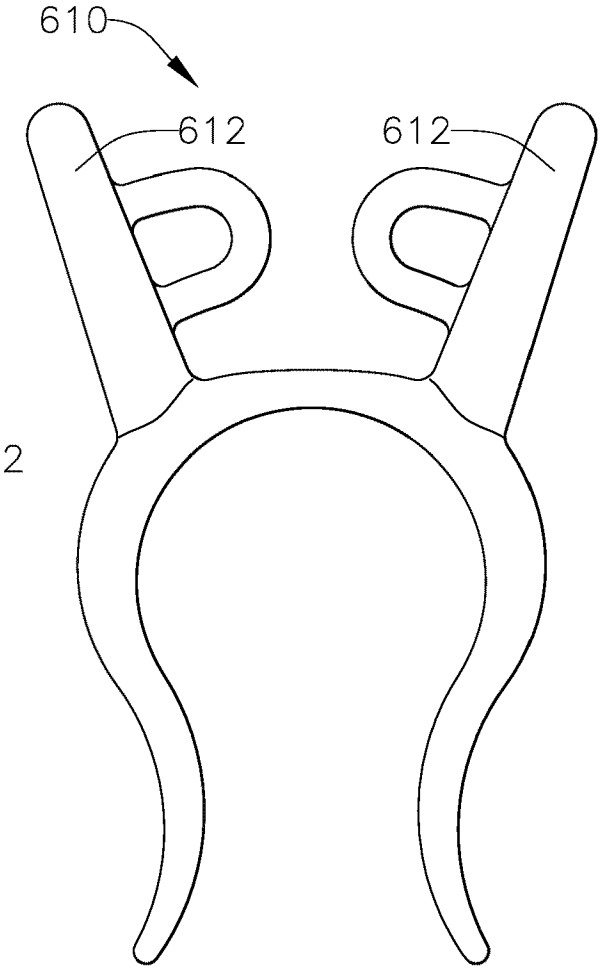
FIG. 34 is a front elevational view of a clip for ornamental pieces, in accordance with an embodiment of the present invention.
Figure 33:
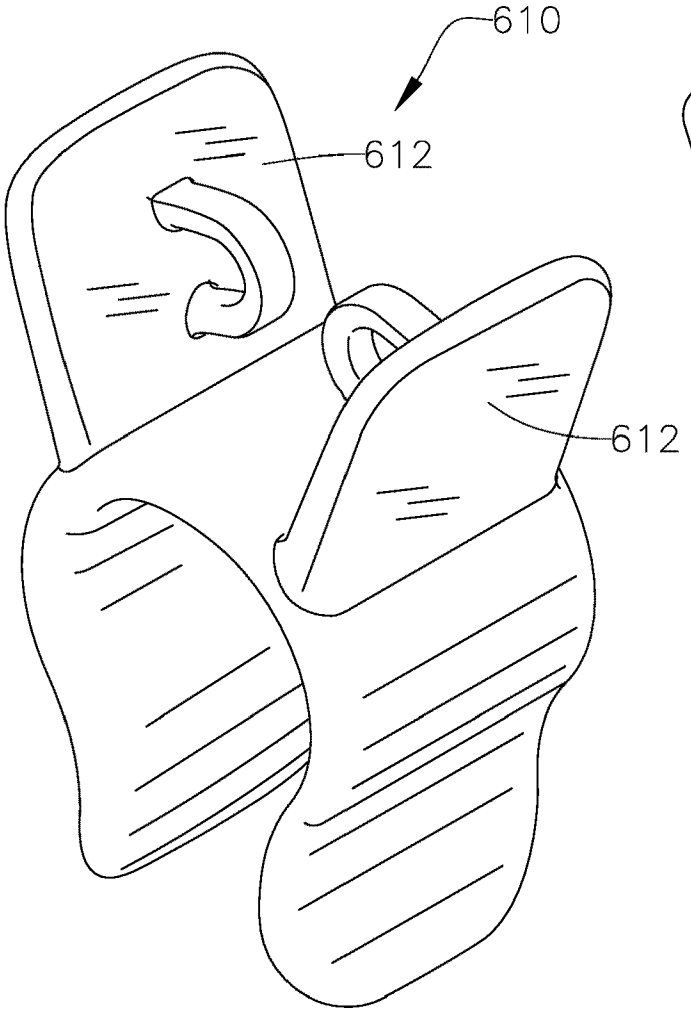
FIG. 33 is a top perspective view of a clip for ornamental pieces, in accordance with an embodiment of the present invention.

Toy building kits are generally most valuable for the user when they enable him or her the largest breadth of possible building options. This can be assessed both in terms of the kit offering more possible interactions of parts or, more broadly, in terms of the kit enabling a larger variety of constructed structures. The present invention is a refinement towards that end. Possible model forts which can be built are shown conceptually FIG. 1. The flags and/or panel pieces can be coupled to individual connector hubs or poles in the same way that the connector hub pieces are coupled to other individual pieces as described below, or they can be attachable via other, independent mechanisms, such as the clip 610 depicted in FIGS. 33-35, which has levers 612 adapted to widen a mouth 614 of clip 610 when pushed towards each other. Clip 610 can, for example clip onto a pole connector 8. In any event, these ornamental pieces do not alter the functionality of the remainder of the kit components.

Figure 1:
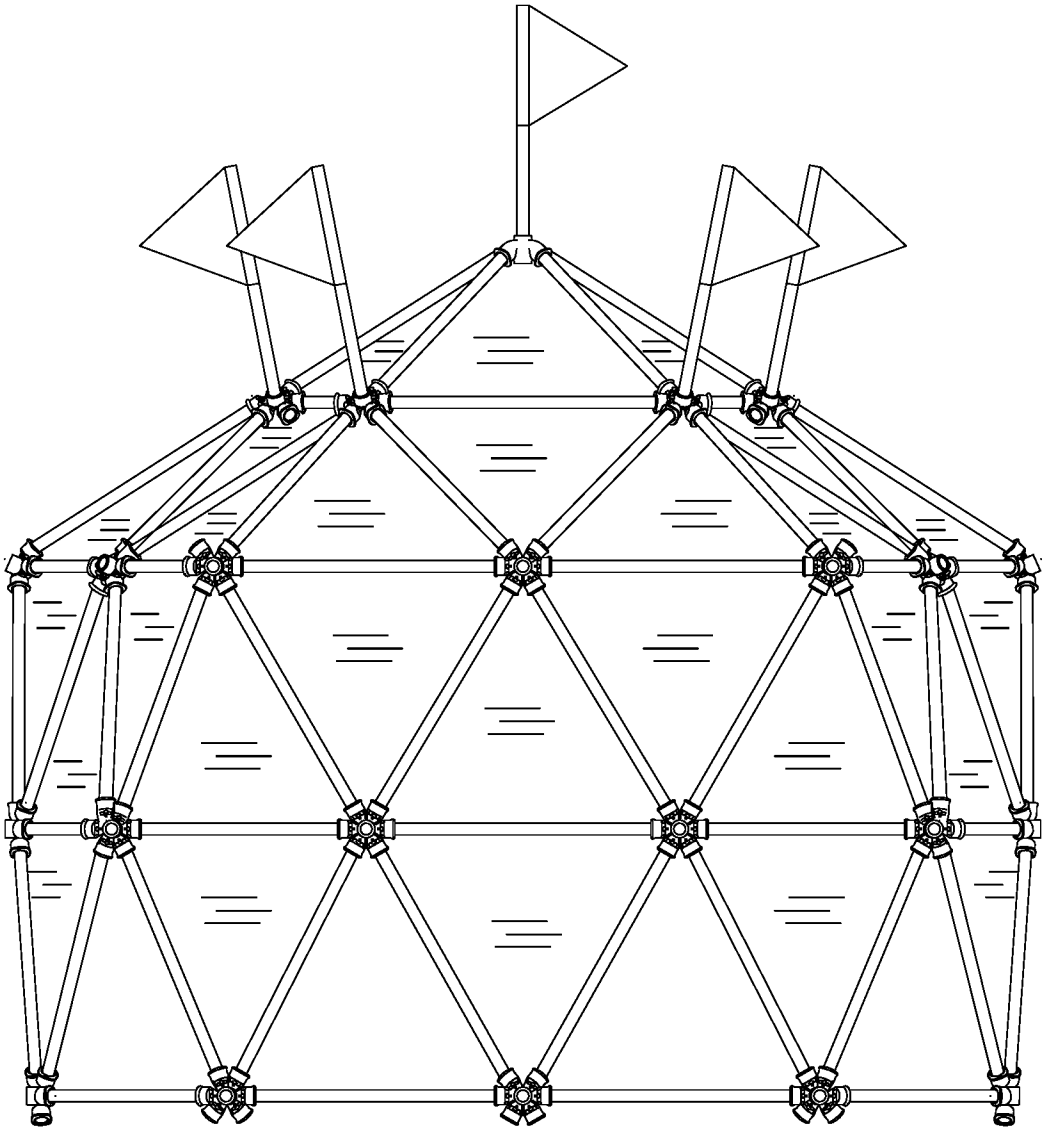
FIG. 1 is a schematic diagram showing a fort built using the building components of the present invention.
Figure 2:
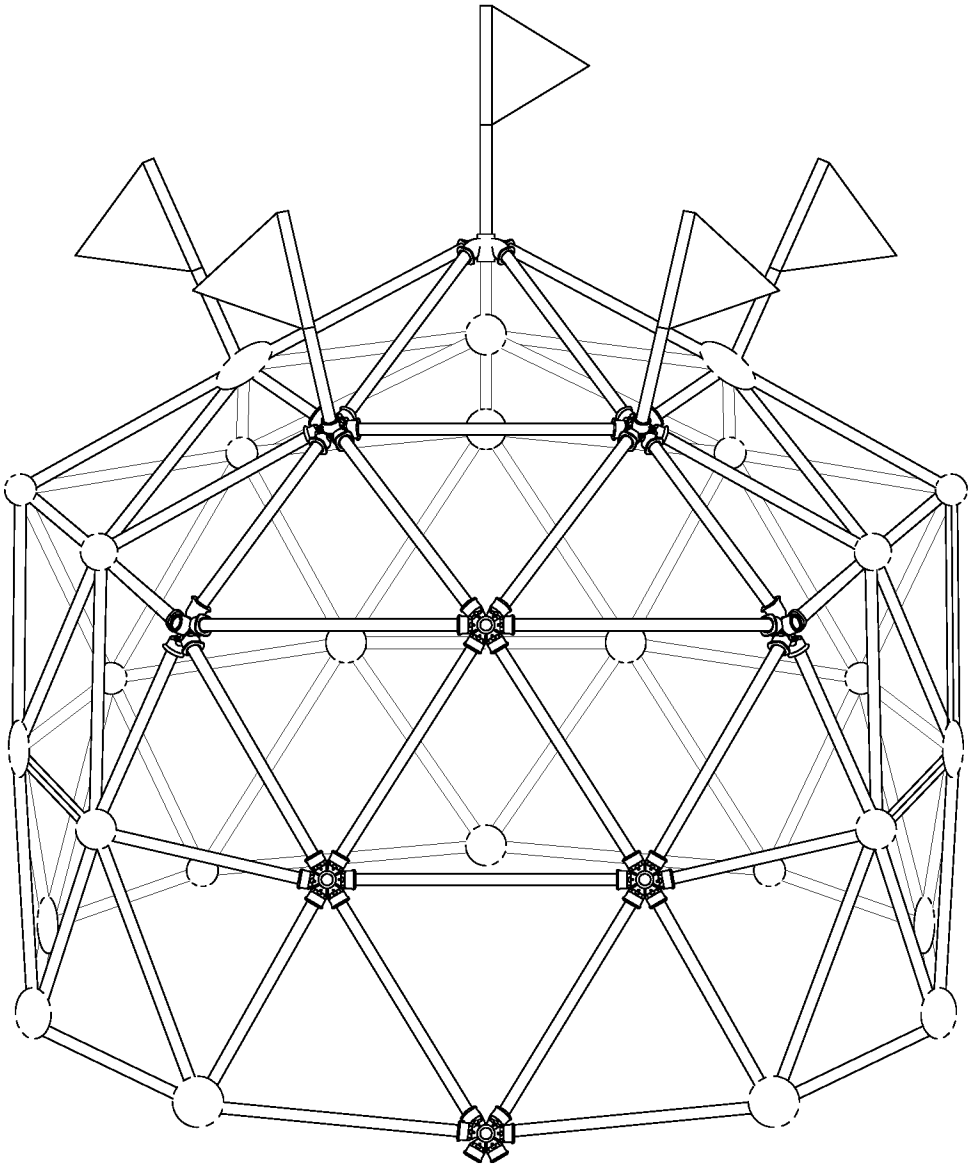
FIG. 2 is a schematic diagram showing an alternate view of the fort of FIG. 1.
Figure 3:
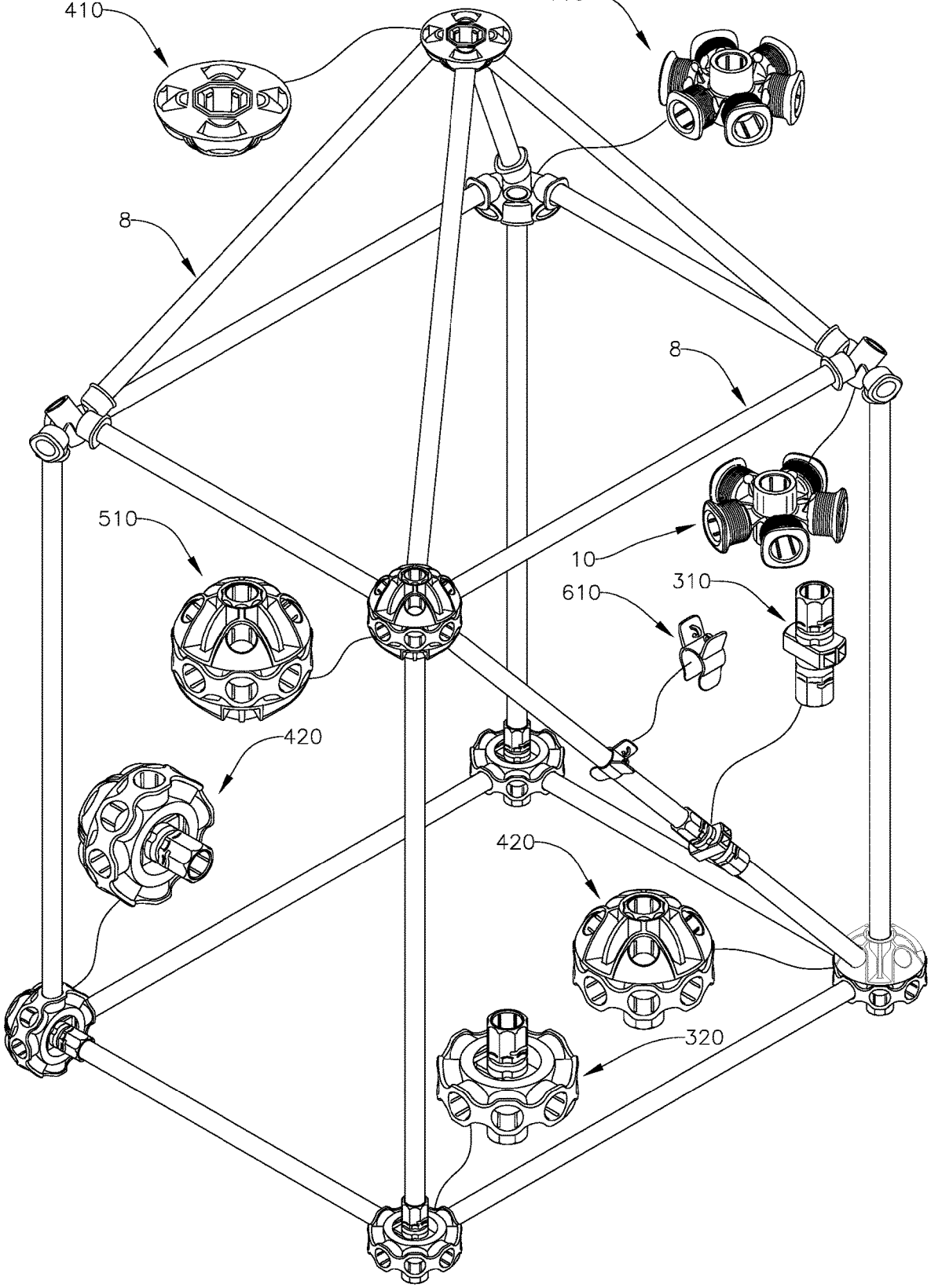
FIG. 3 is a schematic diagram illustrating various components of the present invention in operation.

As can be seen in FIGS. 1-3, the majority of a completed structure is defined by a series of pole-shaped connectors 8 (see FIGS. 4-9). These poles 8 define a shape (e.g., a facsimile of a building) by connecting to one another via connector hub pieces. These hubs can be used to line up two poles in the same direction (i.e., collinearly), or the hubs can act as joints to position two poles at angles (e.g., perpendicularly) with respect to one another.

The kit components described herein can be made of plastic or any other suitable material. In certain embodiments, the components can be manufactured via an injection molding process.

Figure 36:
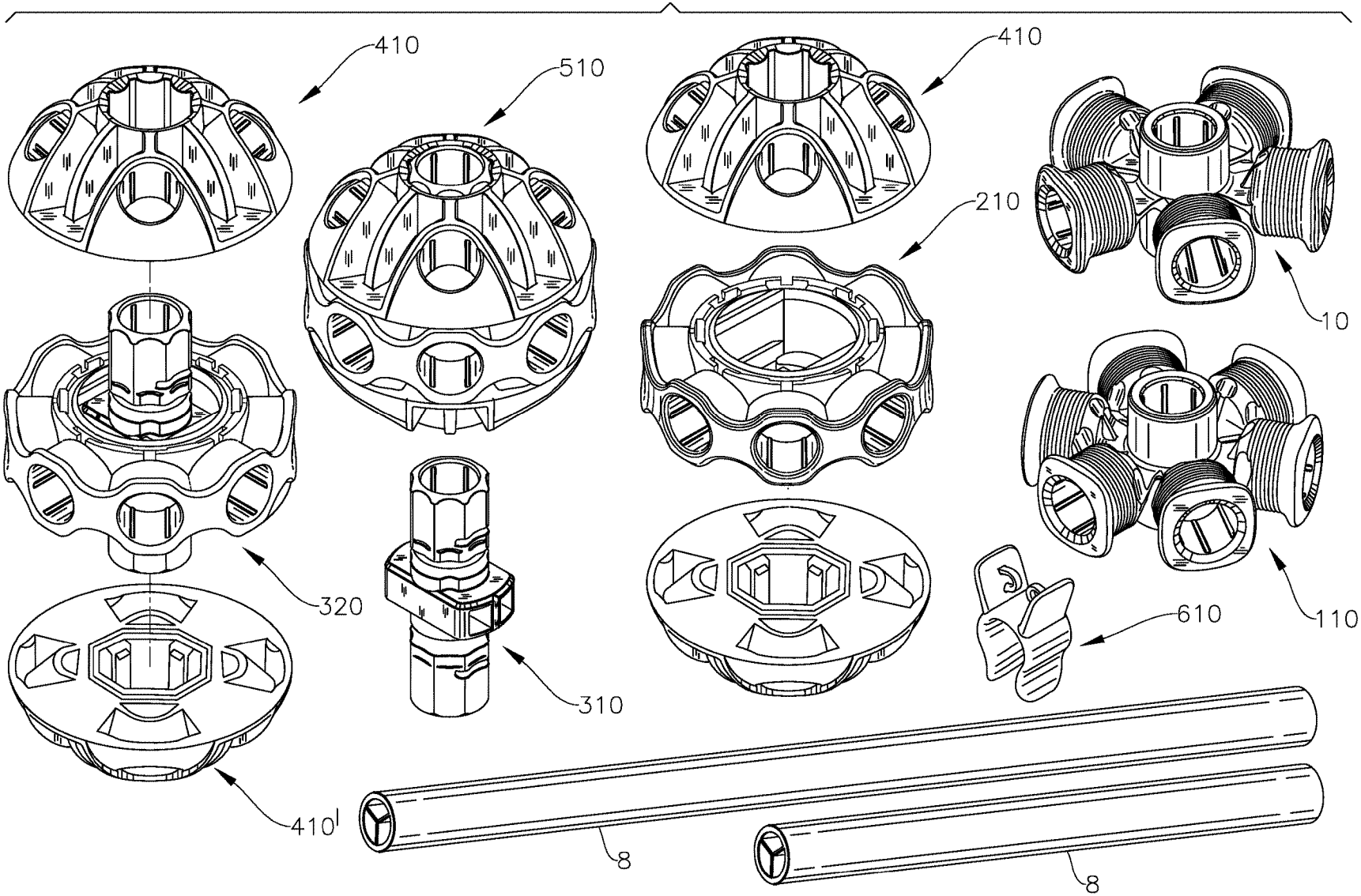
FIG. 36 is a sketch showing various building kit components, including those of FIGS. 1-35, in accordance with an embodiment of the present invention.
Figure 37:
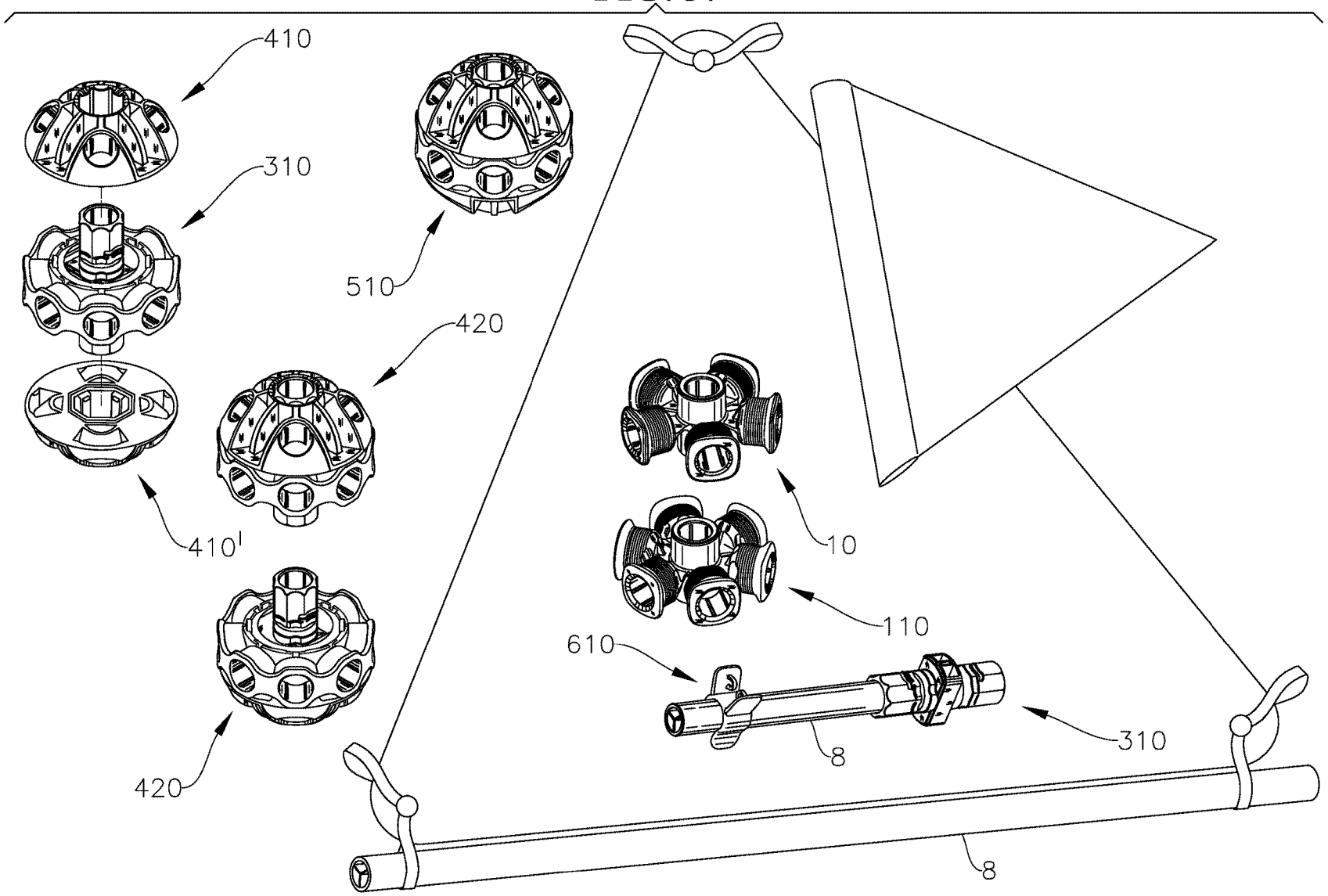
FIG. 37 is an alternate sketch showing various building kit components, including those of FIGS. 1-35, in accordance with an embodiment of the present invention.

In a preferred embodiment, the pole connectors are rigid; however, in some embodiments, they may be flexible. On the most basic level, the poles interact with connector hub pieces by being received in one or more ports on the hub. In some embodiments, for better compatibility with the ports, the ends of the poles may have associated retention devices (not shown), such as a structure at the end of the poles, to facilitate a more secure fit with the ports. These retention devices can be magnetically-based (e.g., in cooperation with magnets in the hubs), use male-to female connectors/threads, or otherwise mechanically secure the pole connectors to the connector hub pieces. In certain embodiments, the retention devices can be selectively removed by the user. In some embodiments, no retention device is used, and a compression and/or friction fit is relied upon. To this end, poles with larger diameters can enhance the fit between the ports and the pole connectors. To increase building versatility, poles of various sizes and/or lengths can be included in a single kit (see especially FIGS. 36 and 37). For aesthetic reasons, or to inhibit entry of foreign substances into the hollow diameter of pole connector 8, an internal shape 5 extending through the length of the pole connector 8 could take up space in the otherwise hollow pole. This internal shape 5 can for instance, be an "X" shape or a "Y" shape and formed by extrusion of material during the manufacturing process of pole connector 8.

Figure 10:
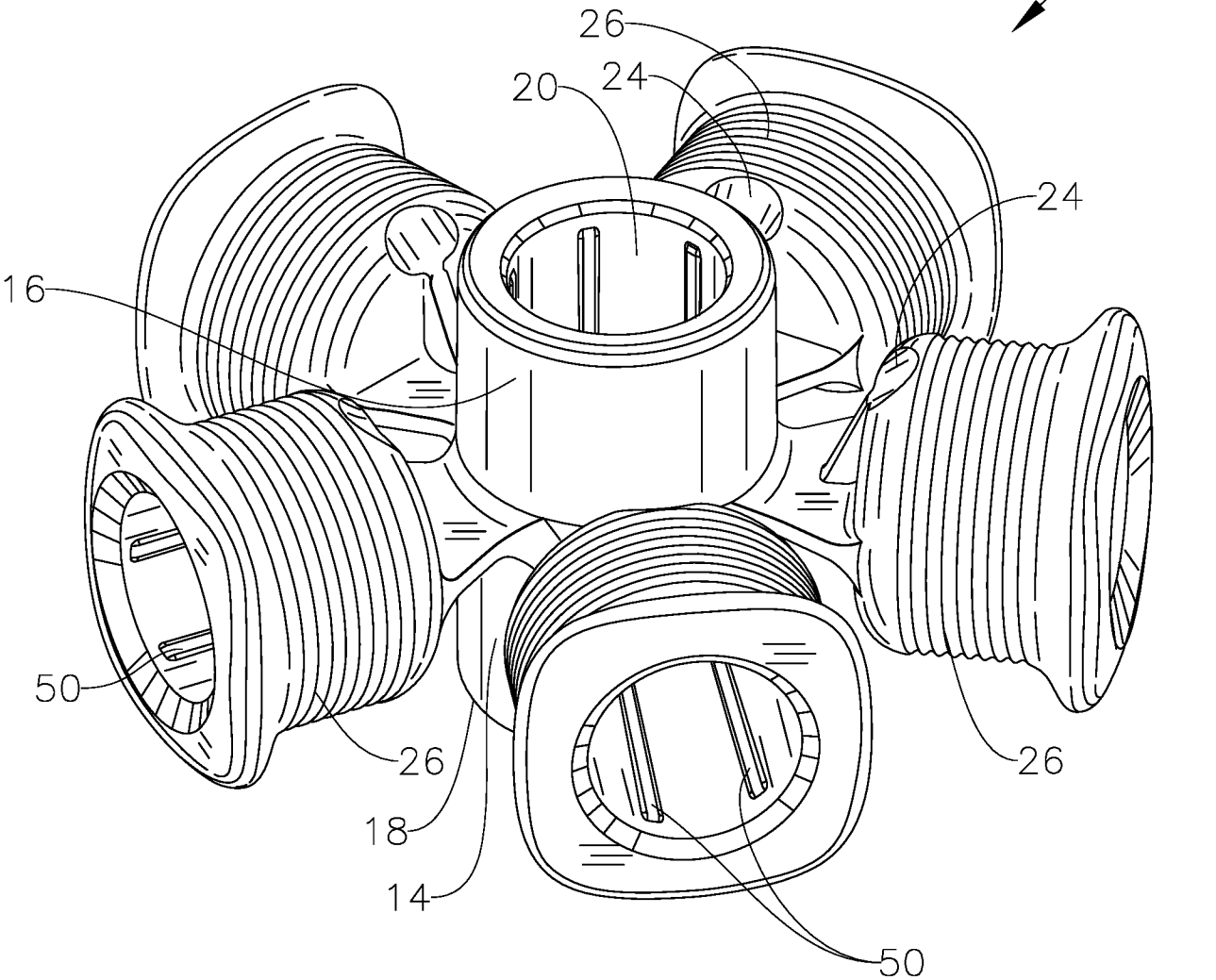
FIG. 10 is a perspective view of a five-point hub piece in accordance with an embodiment of the present invention.

FIG. 10 shows a schematic of a kit component. Specifically, it is a multi-sided five-point connector hub 10 with five lateral ports 12 spaced around the circumference of a cylindrical base 14. The base 14 itself has a pair of opposing ports 16, 18 on opposing ends of base 14. Like the lateral ports 12, the opposing ports 16, 18 operate to receive pole connectors. In one embodiment, each opposing port 16, 18 has a dead-end configuration, wherein there is no interconnection between ports 16, 18. In alternate embodiments, a lumen 20 is defined therebetween. In some embodiments, lumen 20 can enable a pole connector (not shown) to pass therethrough, with or without resistance. In another embodiment, one or more of opposing ports 16, 18 has a stop 22, which serves to allow ports 16, 18 to receive a pole connector without allowing the pole to pass completely through lumen 20. In this manner, two pole connectors can be received, one in each of ports 16, 18 without any mutual interference. For an improved friction fit, fingers 50 can be provided on the inner walls of ports 12, 16, 18.

Figure 16:
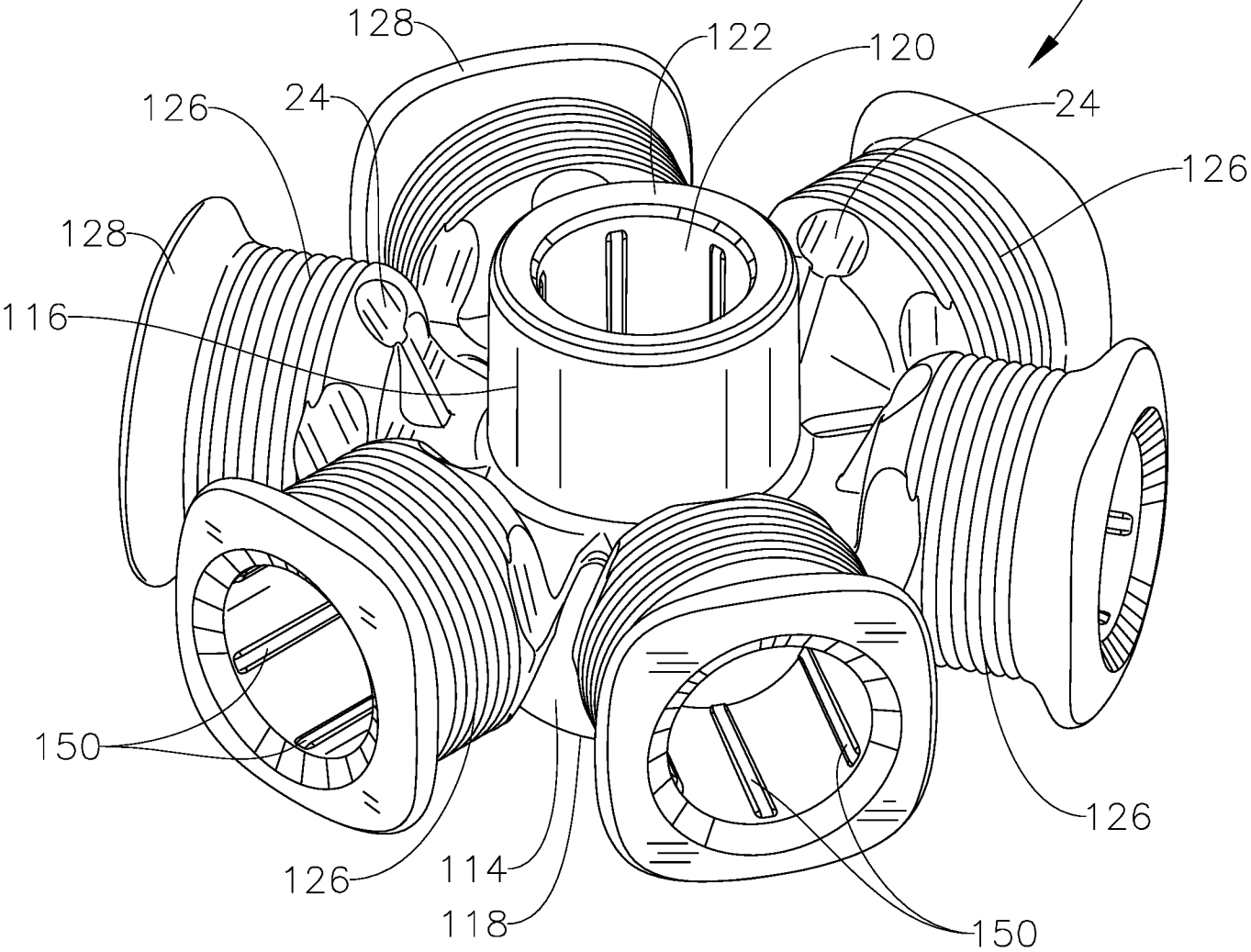
FIG. 16 is a perspective view of a six-point hub piece in accordance with an embodiment of the present invention.
Figure 17:
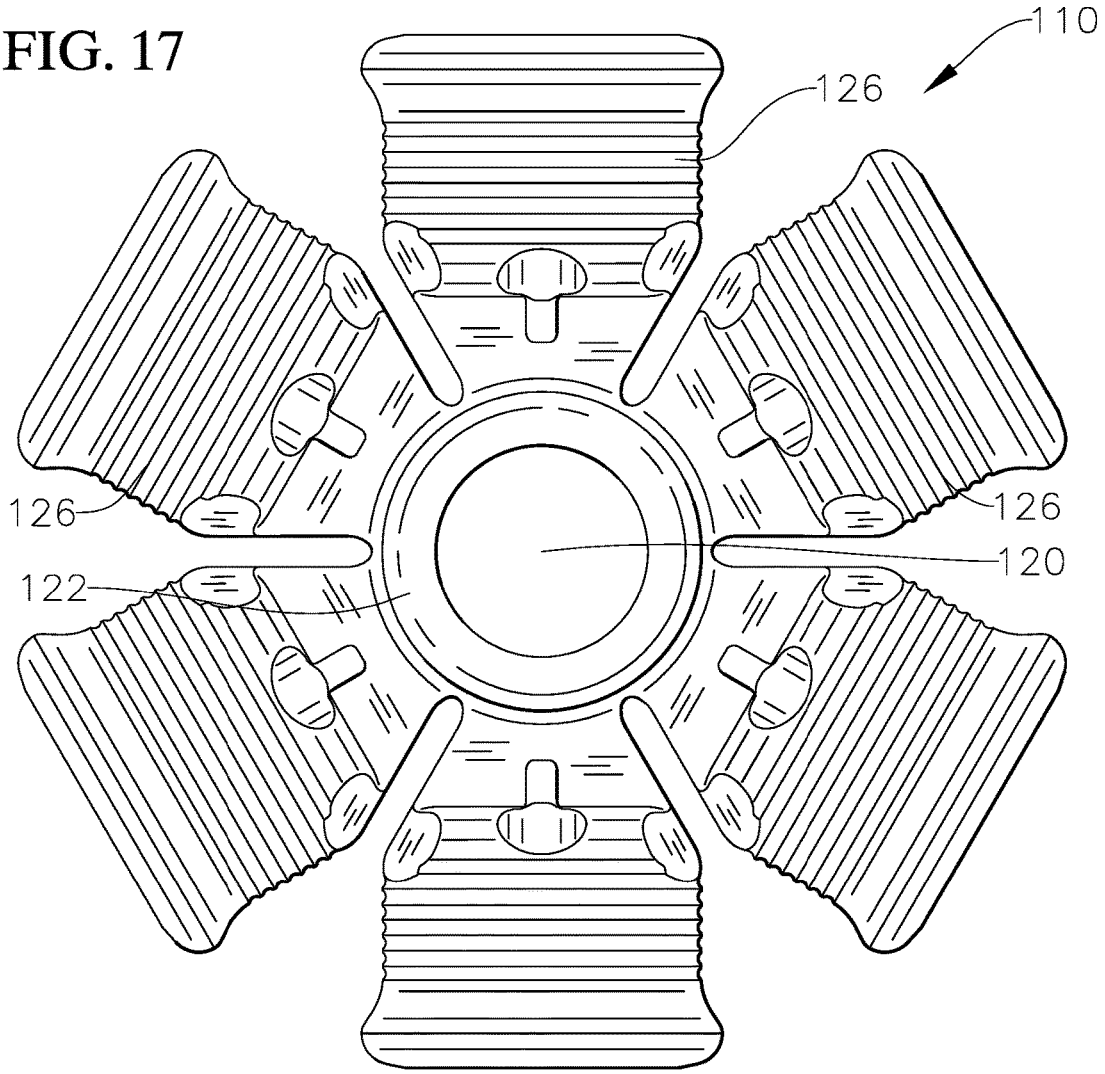
FIG. 17 is a top view of a six-point hub piece in accordance with an embodiment of the present invention.
Figure 18:
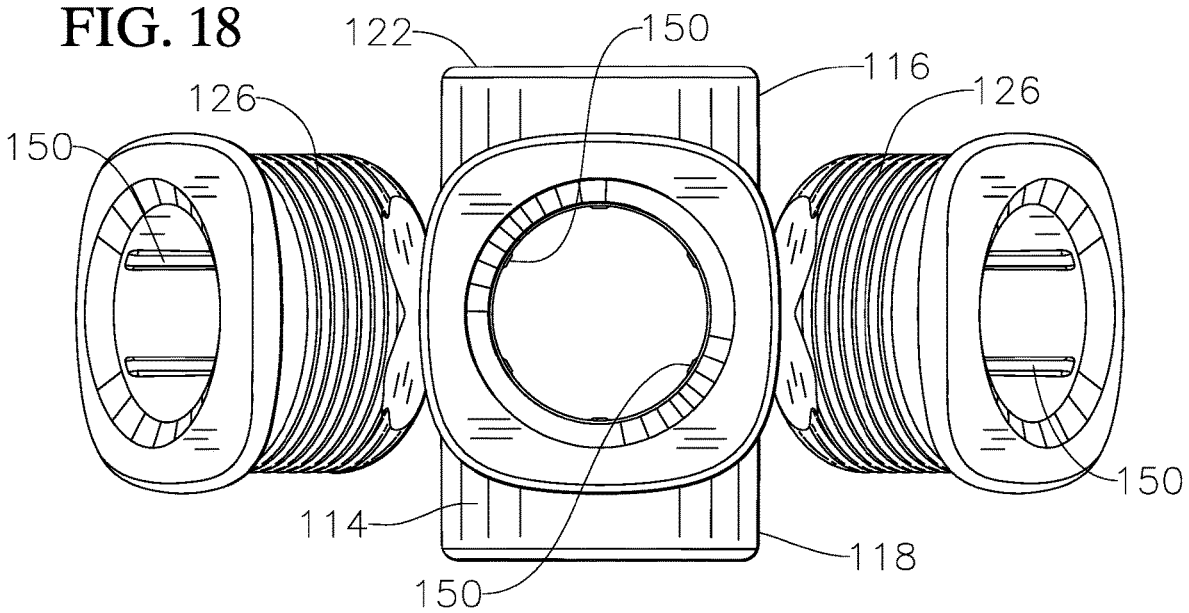
FIG. 18 is an elevational view of a six-point hub piece in accordance with an embodiment of the present invention.
Figure 19:
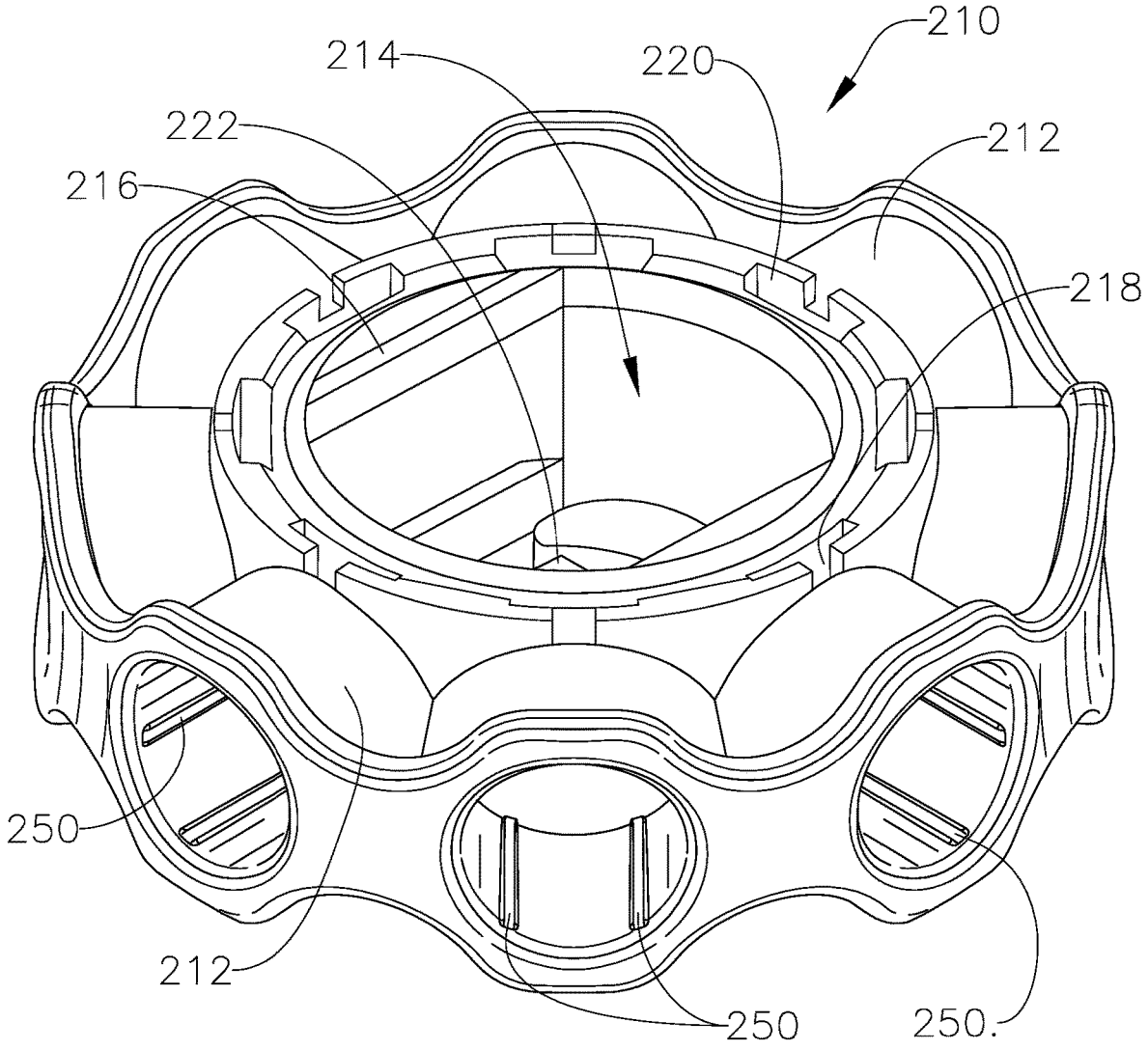
FIG. 19 is a perspective view of an eight-point hub piece, in accordance with an embodiment of the present invention.
Figure 20:
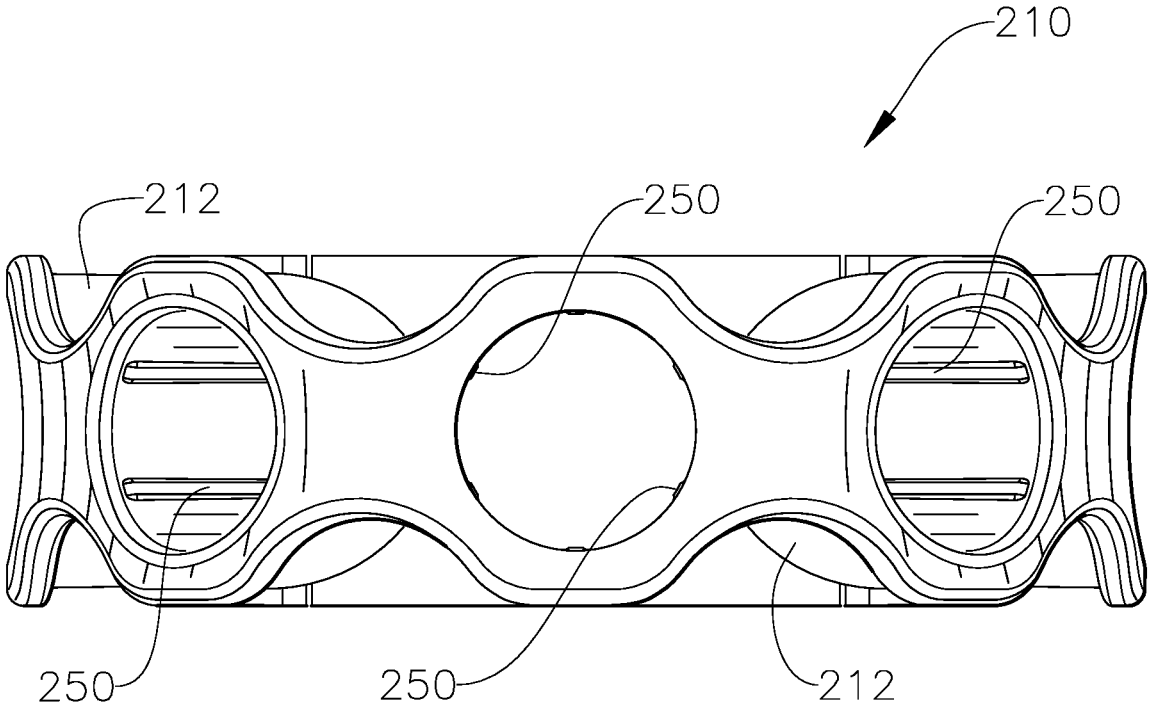
FIG. 20 is an elevational view of an eight-point hub piece, in accordance with an embodiment of the present invention.
Figure 21:
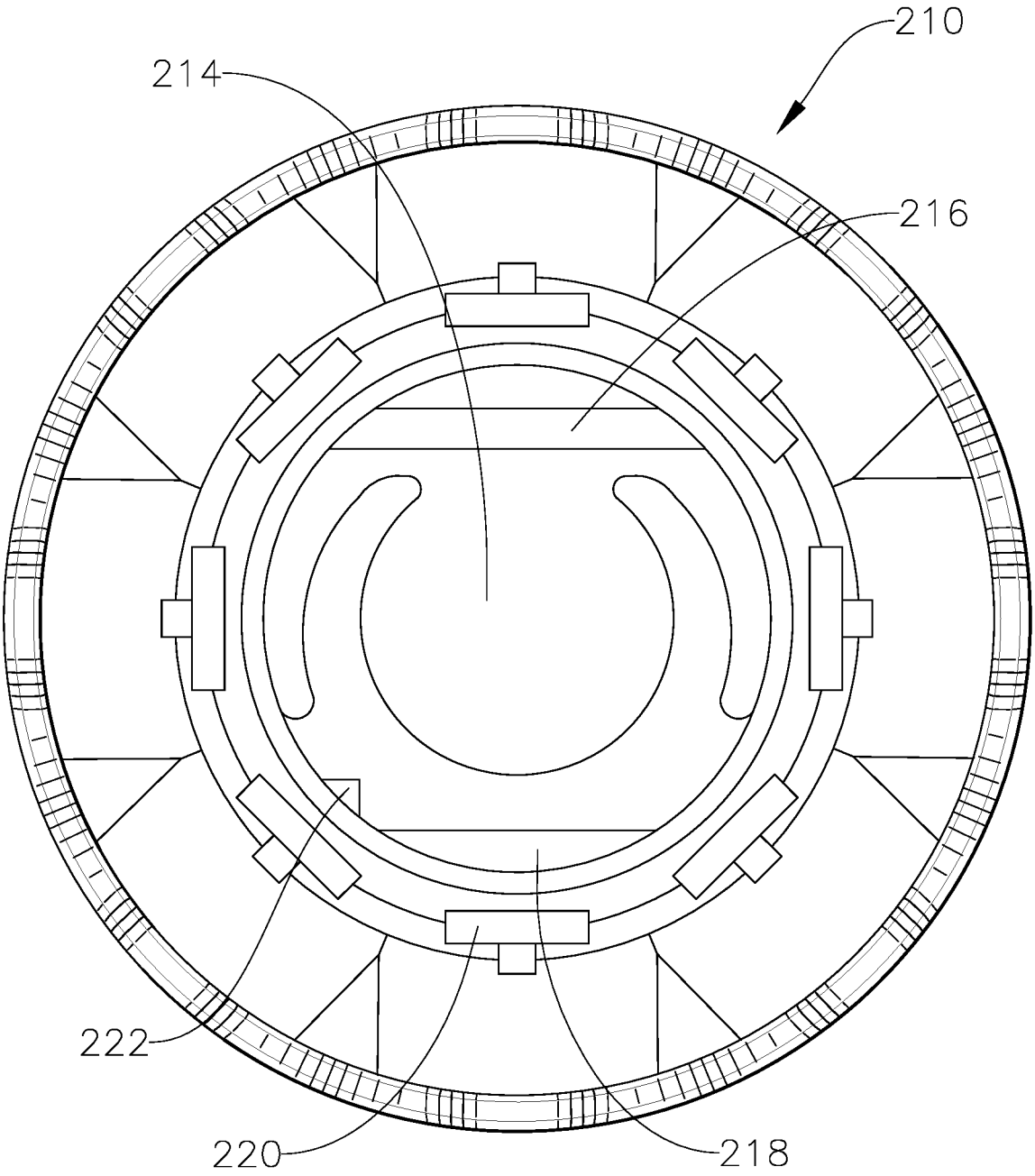
FIG. 21 is a bottom view of an eight-point hub piece, in accordance with an embodiment of the present invention.
Figure 22:
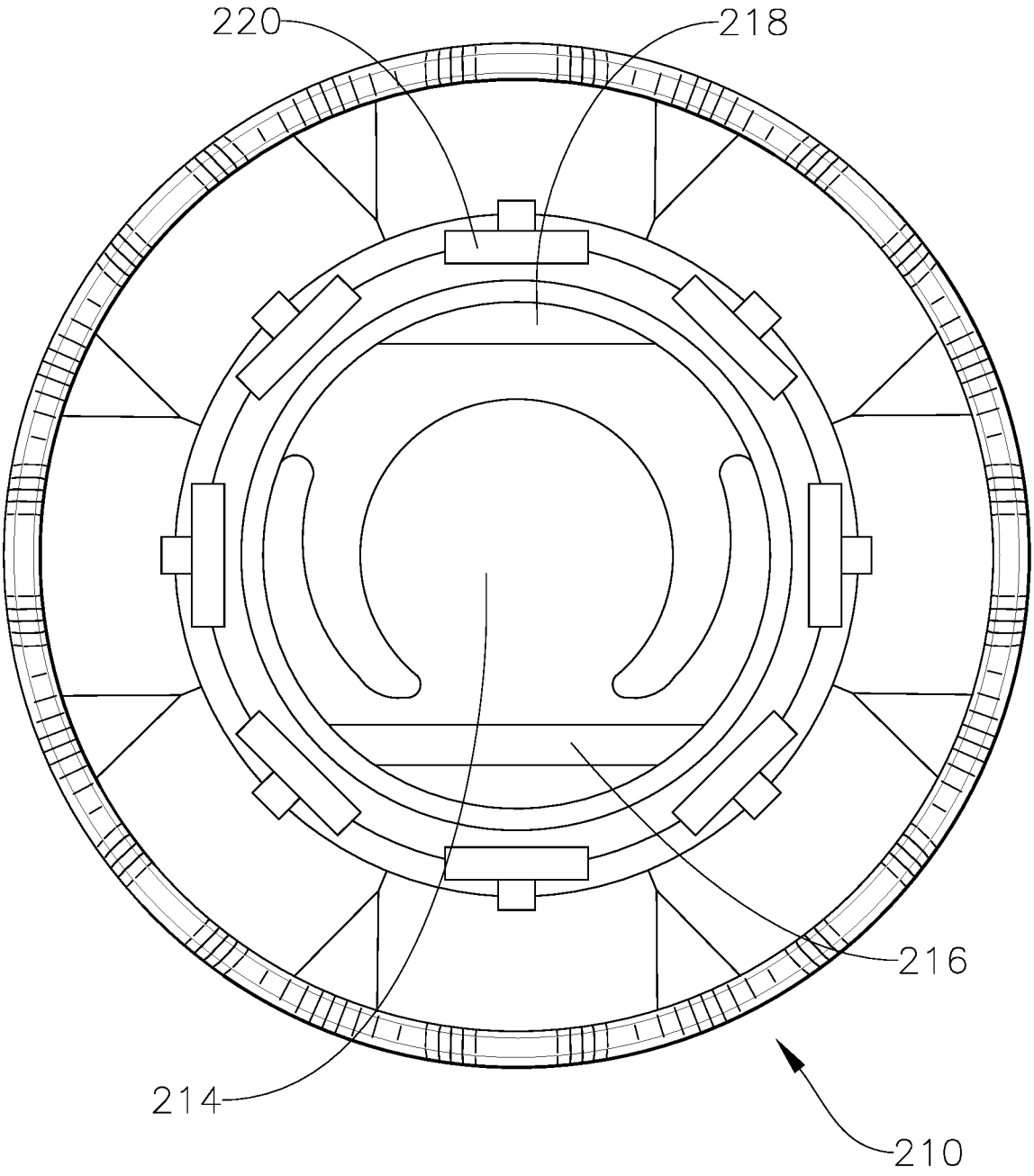
FIG. 22 is a top view of an eight-point hub piece, in accordance with an embodiment of the present invention.

FIGS. 16-18 show a representation of a second kit component, a six-point connector hub 110, which operates similarly to five-point hub 10. Specifically, six-point hub 110 is multi-sided and has six lateral ports 112 spaced around the circumference of a cylindrical base 114. The base 114 itself has a pair of opposing ports 116, 118 on opposing ends of base 114. Like the lateral ports 112, the opposing ports 116, 118 operate to receive pole connectors. In one embodiment, each opposing port 116, 118 has a dead-end configuration, wherein there is no interconnection between ports 116, 118. In alternate embodiments, a lumen 120 is defined therebetween. In some embodiments, lumen 120 can enable a pole connector (not shown) to pass therethrough, with or without resistance. In another embodiment, one or more of opposing ports 116, 118 has a stop 122, which enables ports 116, 118 to receive a pole connector without allowing it to pass through lumen 120. In this manner, two pole connectors can be received, one in each of ports 116, 118 without any mutual interference. For an improved friction fit, fingers 150 can be provided on the inner walls of ports 112, 116, 118. Another possibility to improve a friction fit would be to provide slits (not shown) in the walls of ports 116, 118, or on the various other ports of the present invention.

Figure 11:
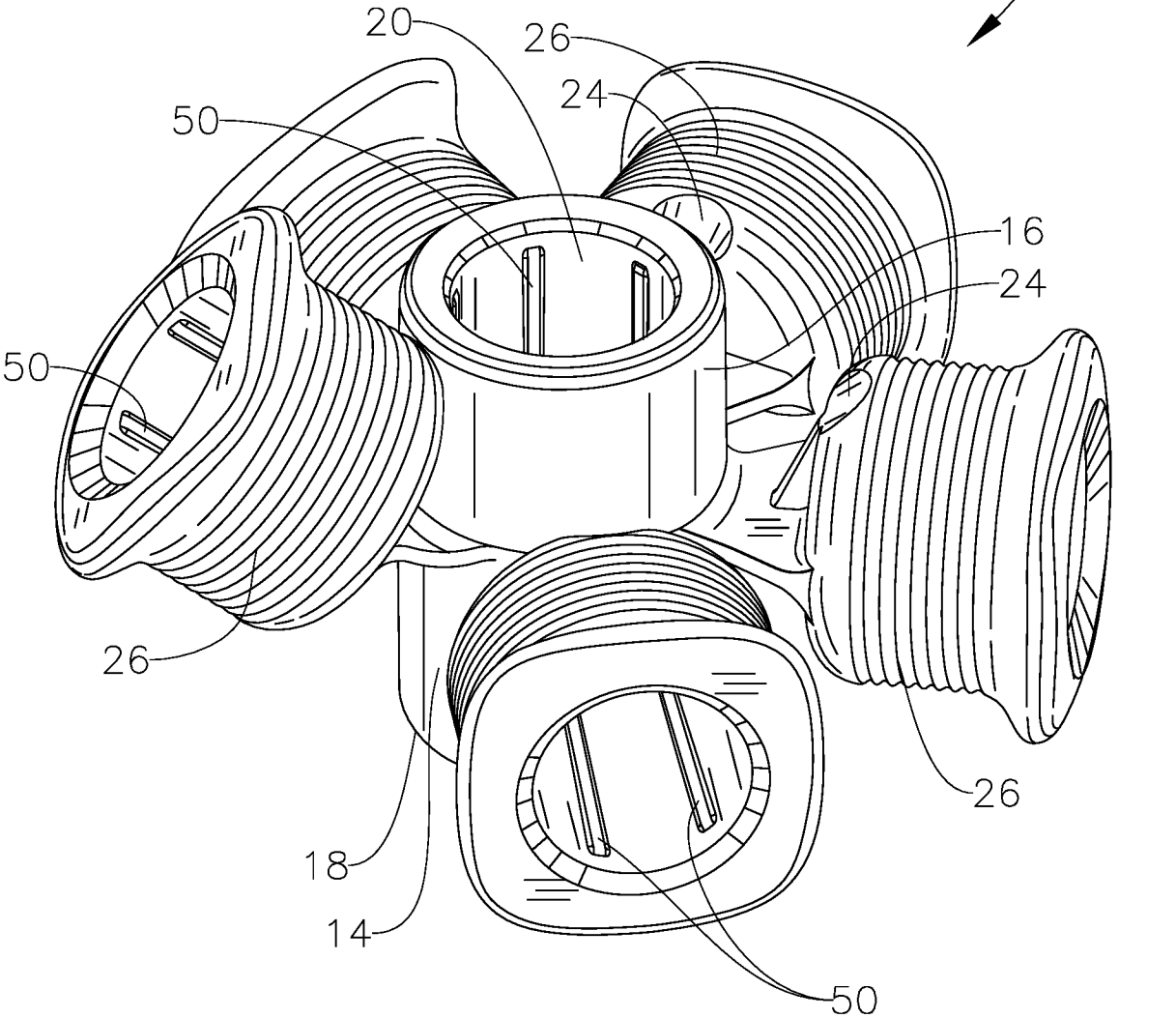
FIG. 11 is a perspective view of a five-point hub piece in a flexed position, in accordance with an embodiment of the present invention.
Figure 12:
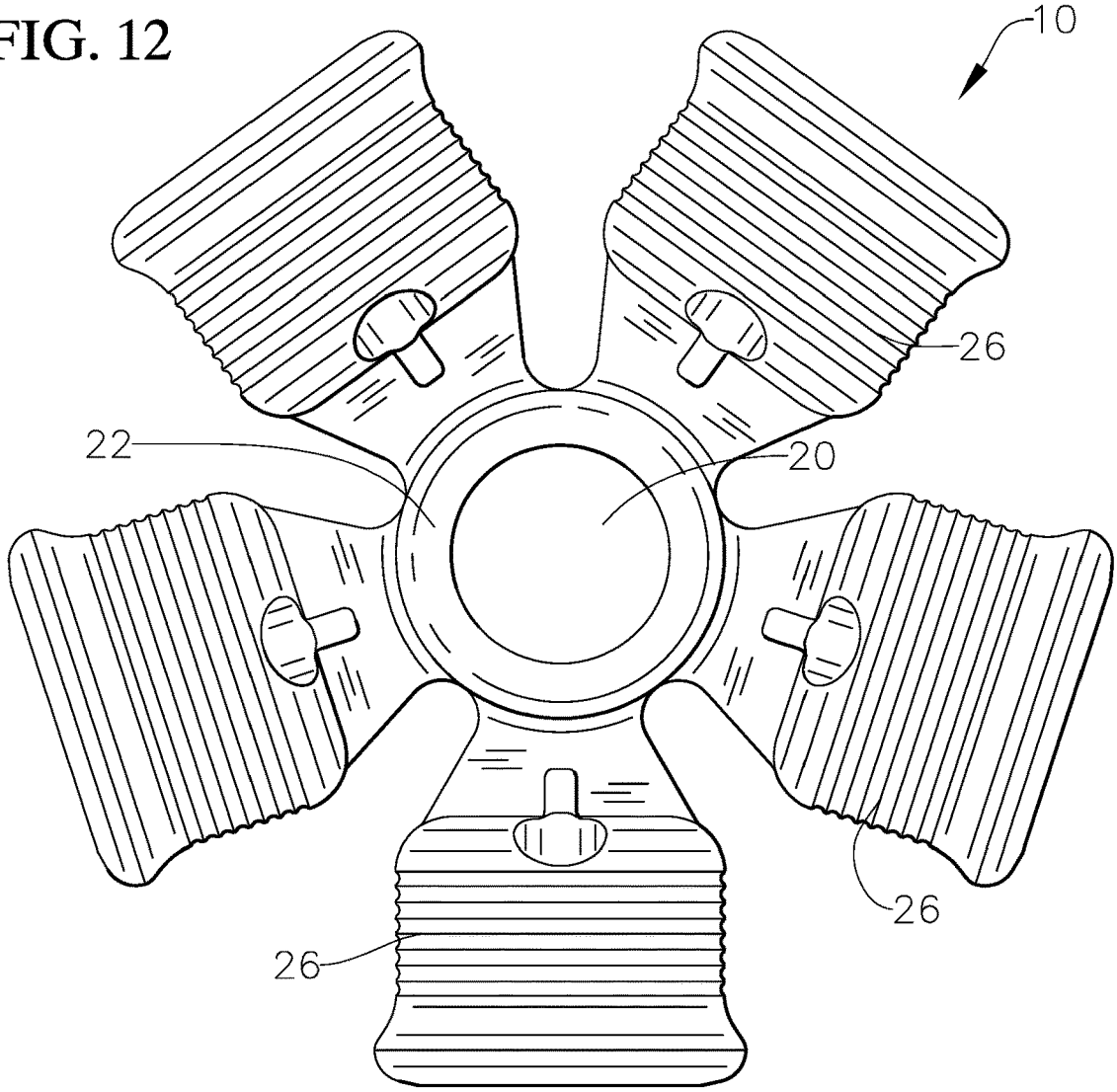
FIG. 12 is a top view of a five point-hub piece in accordance with an embodiment of the present invention.
Figure 13:
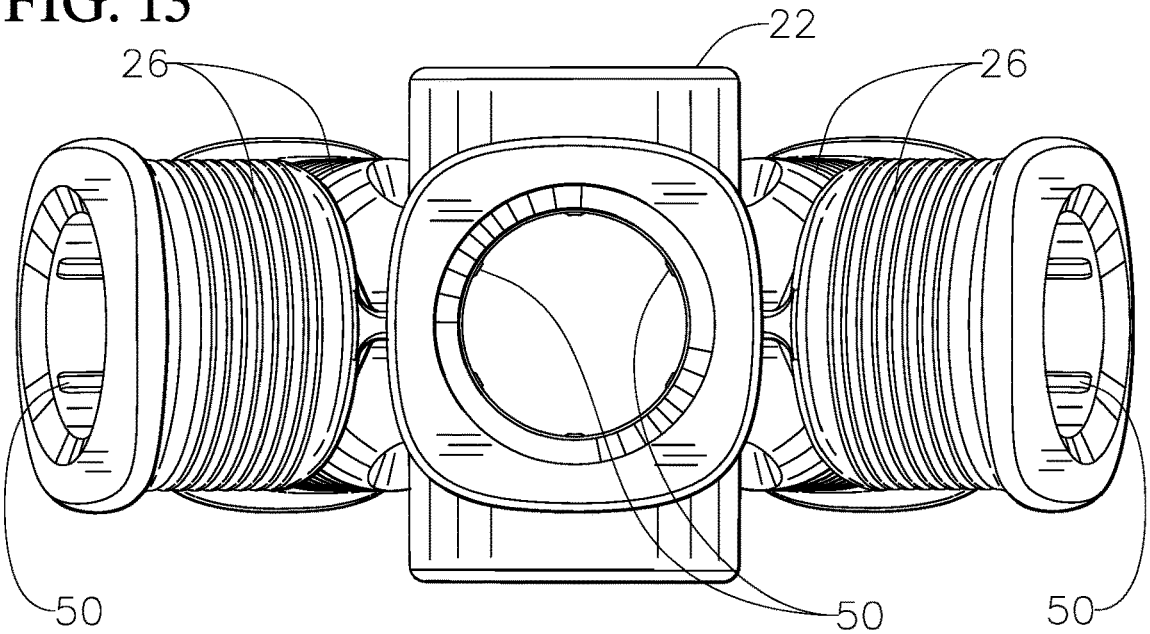
FIG. 13 is a top view of a five point-hub piece in a flexed position in accordance with an embodiment of the present invention.
Figure 14:
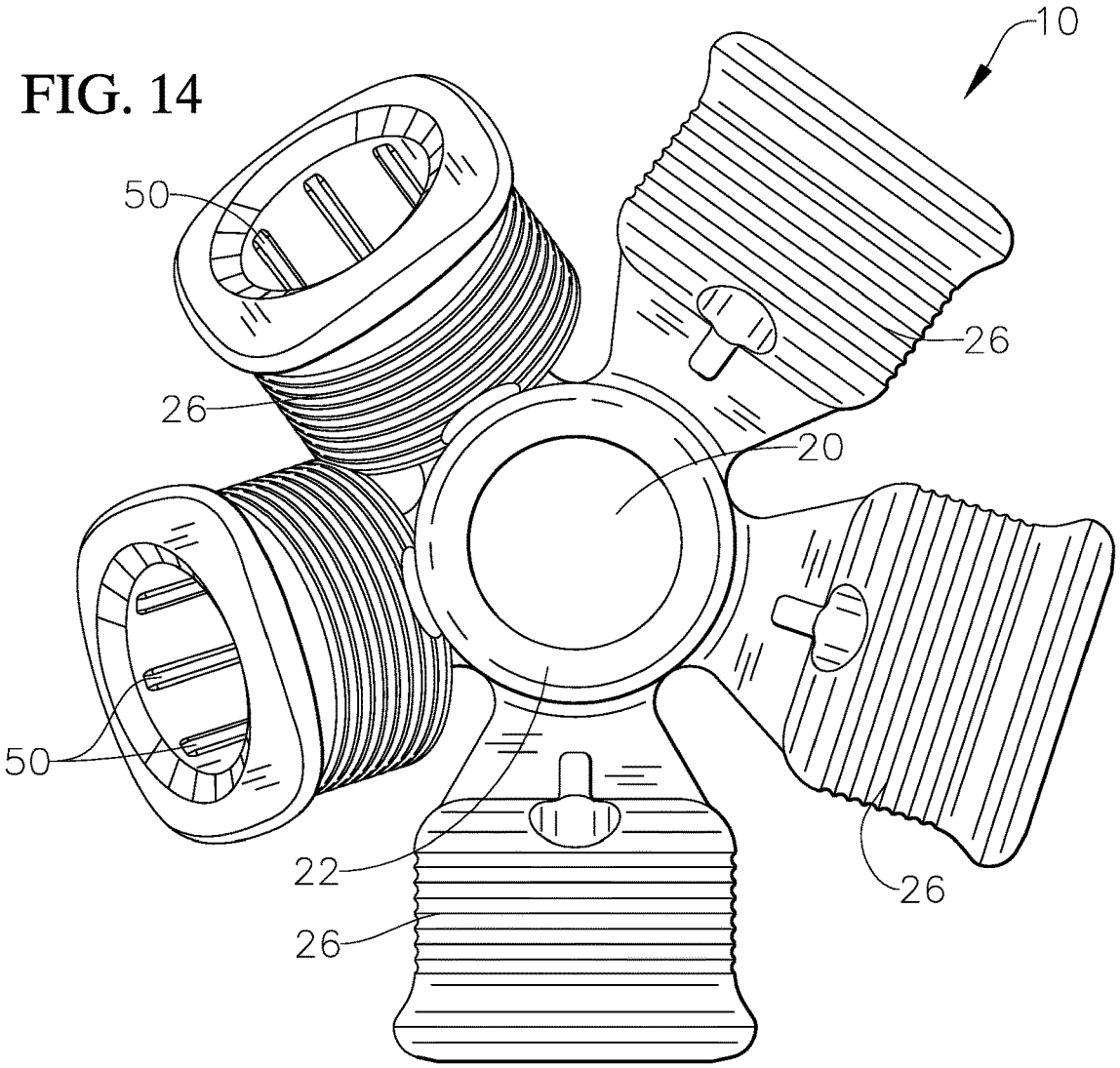
FIG. 14 is an elevational view of a five-point hub piece in accordance with an embodiment of the present invention.
Figure 15:
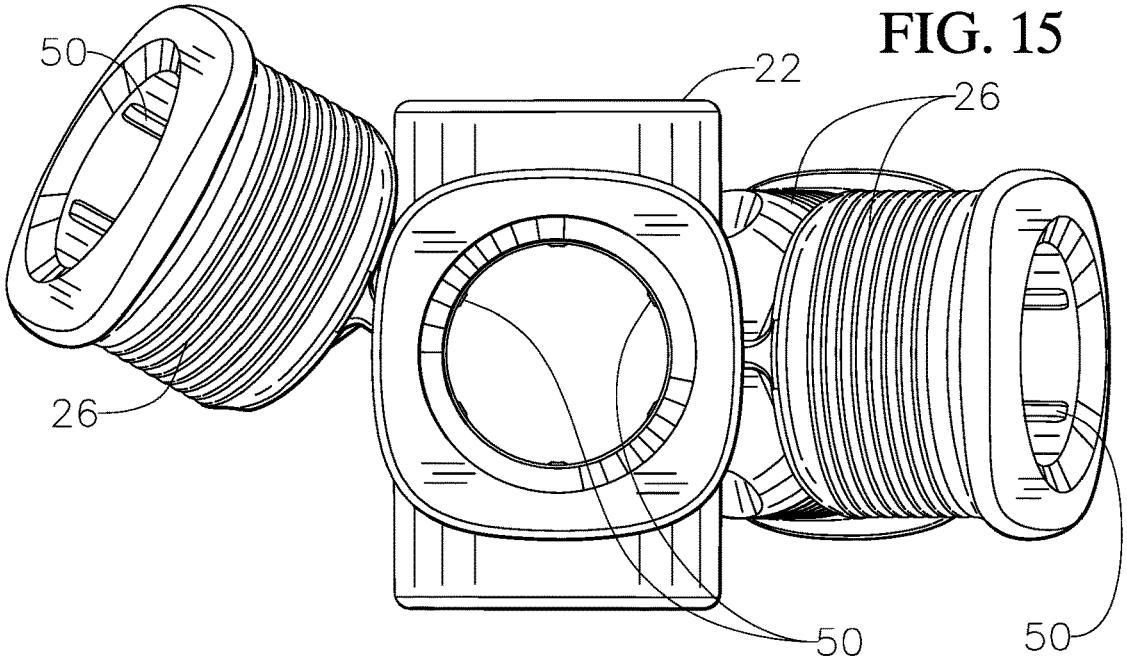
FIG. 15 is an elevational view of a five point-hub piece in a flexed position in accordance with an embodiment of the present invention.

In an embodiment, both connectors 10 and 110 can be made of a flexible material (see FIGS. 11, 13 and 15). In an embodiment, connectors 10, 110 are manufactured via an injection molding process. When made to be flexible, lateral ports 12, 112 can be elastically moved into positions different from their default orientations. Two or more lateral ports 12, 112 can be moved in the same direction; alternatively, some of ports 12, 112 can be moved in different (i.e., opposite) directions. In such instances, any lateral ports 12, 112 positioned in this fashion will flex back to their default position when the forces on them are released. However, when the lateral ports 12, 112 are connected to a pole connector that is fixed in position (e.g., one that is part of a constructed structure), tension forces will function to maintain lateral ports 12, 112 in their alternate positions. To this end, hubs 10, 110 can operate as unique joint connectors (e.g., corner connectors) that can place pole connectors in additional orientations/angles than those described elsewhere herein. In an embodiment, flexible hubs 10, 110 can be adapted to better comply with the lateral ports 12, 112 in flexed position. To this end, a plurality of dimples 24, 124 can be placed around opposing ports 16, 116, 18, 118. These dimples 24, 124 serve as a stop to flexed ports 12, 112 and add to the versatility of hubs 10, 110. In an embodiment, the dimples 24, 124 can be substituted for triangular tabs (not shown) that perform the same function as dimples 24, 124 (i.e., as a stop) or can complement them.

To improve the ease of connecting and disconnecting poles 8 to hubs 10, 110 ribbing 26, 126 can be added to the outer circumference of lateral ports 12, 112 to facilitate the gripping of ports 12, 112. To enable ease of use, ports 12, 112 can also have a lip 28, 128 with a diameter greater than the inner diameter of ports 12, 112. This adaption facilitates separation of connector poles from hubs 10, 110.

In further embodiments of the present invention, additional connectors are provided as part of a kit. FIGS. 19-22 show an eight-sided connector hub 210. Like connectors 10, 110, eight-sided connector hub 210 has a plurality of lateral ports 212 that can receive connector pole(s). Connector 210 is annular in shape, with a central opening 214 passing therethrough. Within said opening 214 is a shelf 216, a neck 218 below and opposite shelf 216, and a pair of grooved walls 220 positioned to the sides of shelf 216 and neck 218, all of which components define opening 214. The function of these parts will be described hereinbelow. When used with only the pole connectors, connector hub 210 allows for placement of up to eight co-planar poles. For an improved friction fit, fingers 250 can be provided on the inner walls of ports 212.

Figure 23:
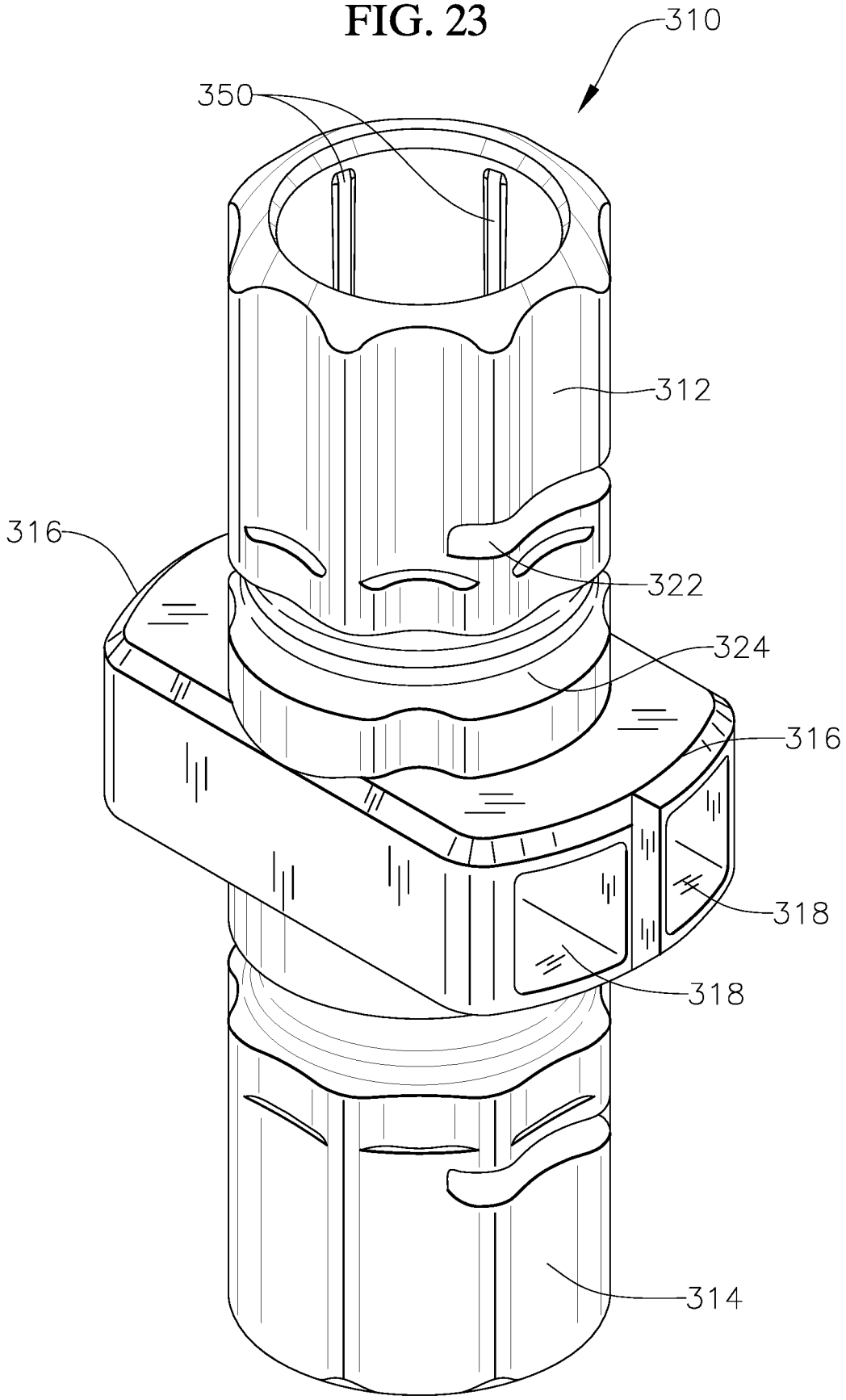
FIG. 23 is a top perspective view of a two-point hub piece in accordance with an embodiment of the present invention.
Figure 24:
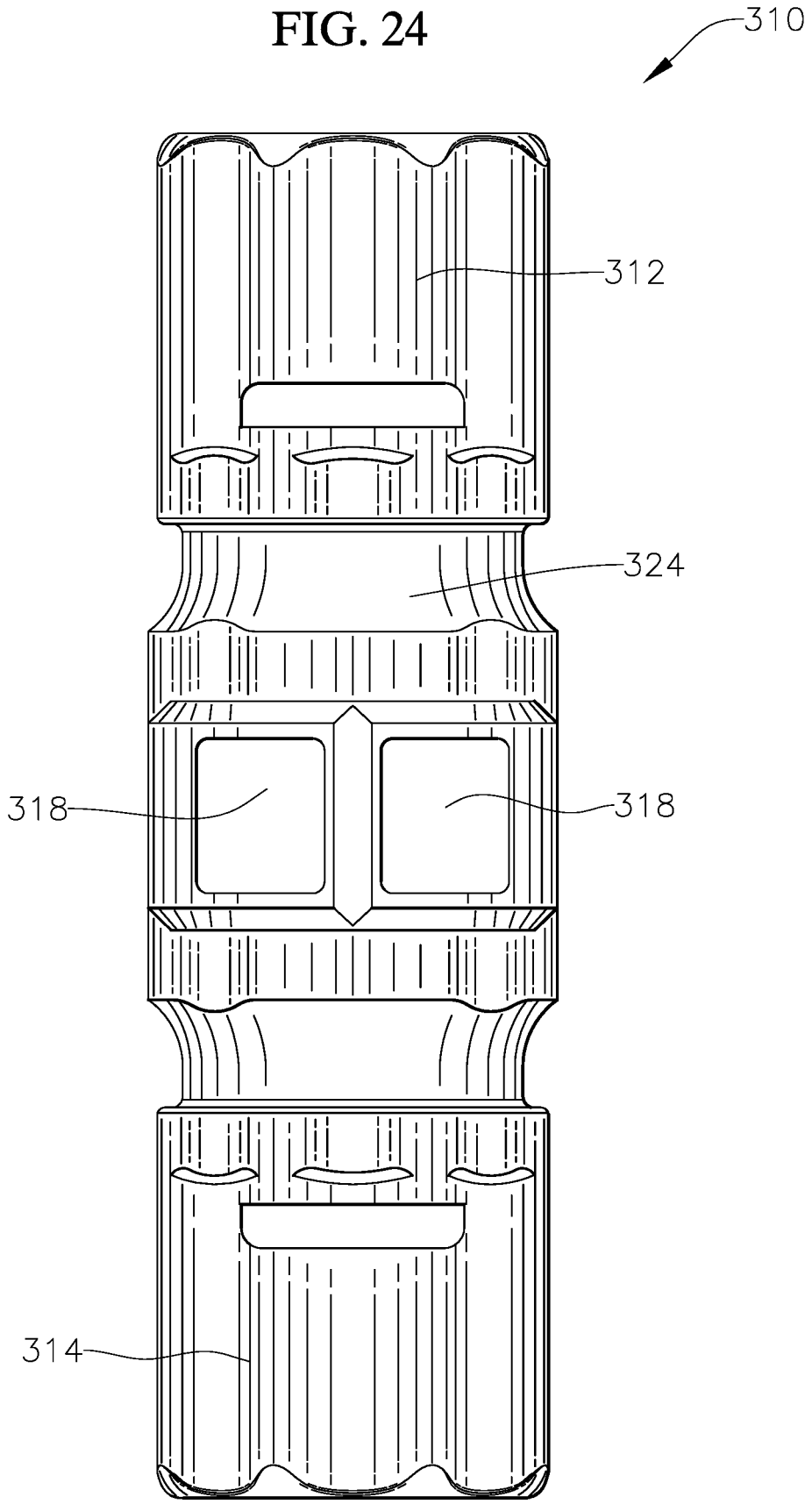
FIG. 24 is a front elevational view of a two-point hub piece in accordance with an embodiment of the present invention.
Figure 25:
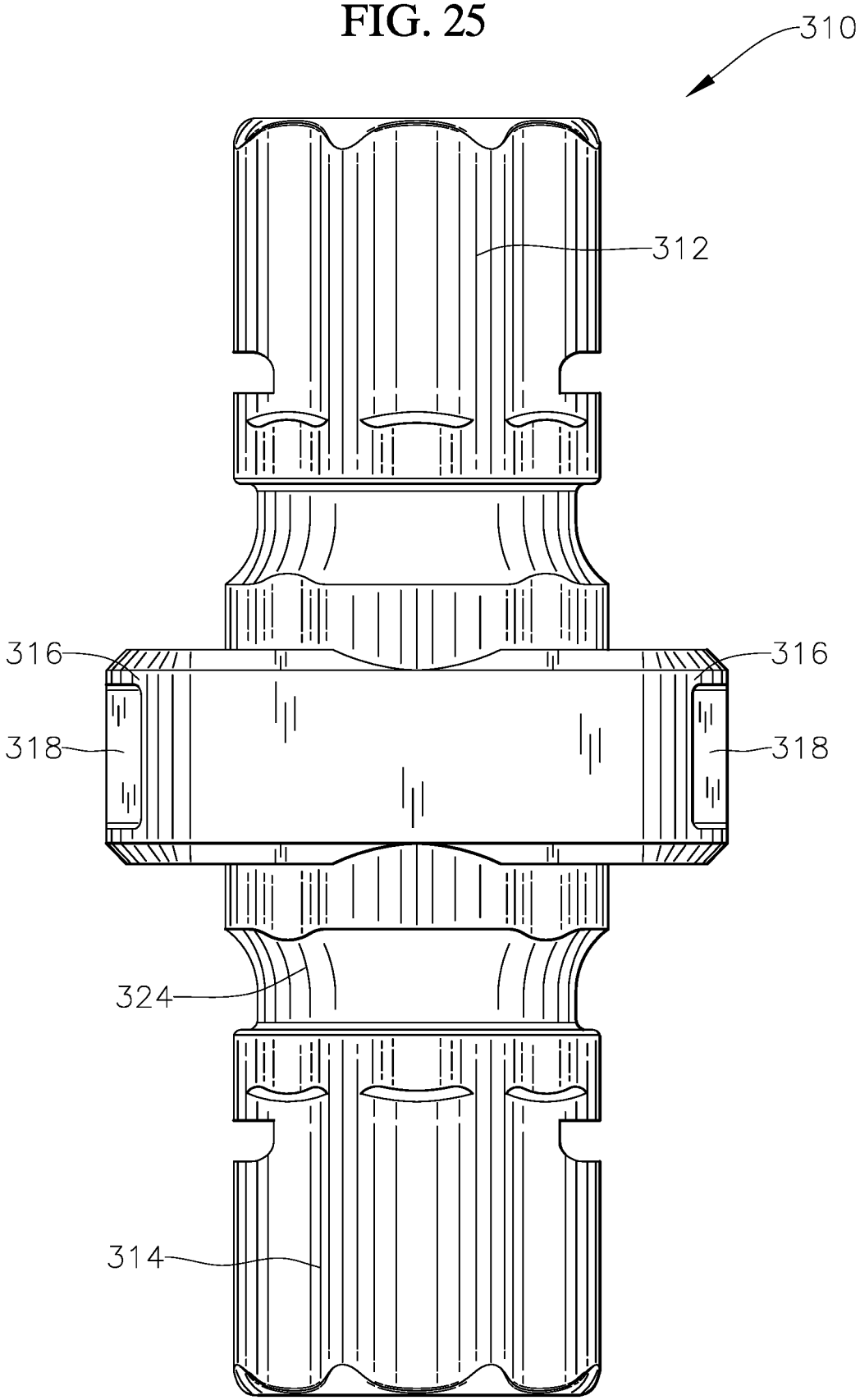
FIG. 25 is a side elevational view of a two-point hub piece in accordance with an embodiment of the present invention.
Figure 26:
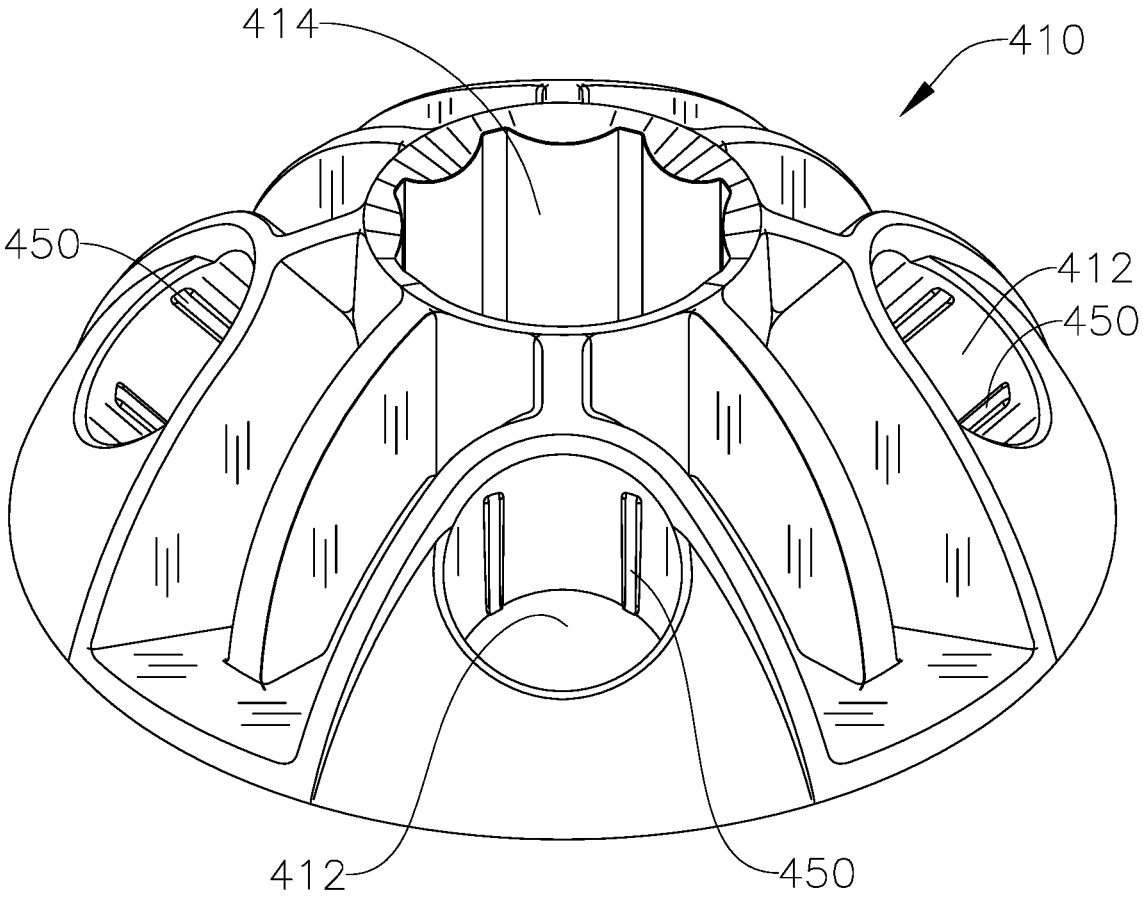
FIG. 26 is a top view of a four-point hemispherical hub piece, in accordance with an embodiment of the present invention.
Figure 27:
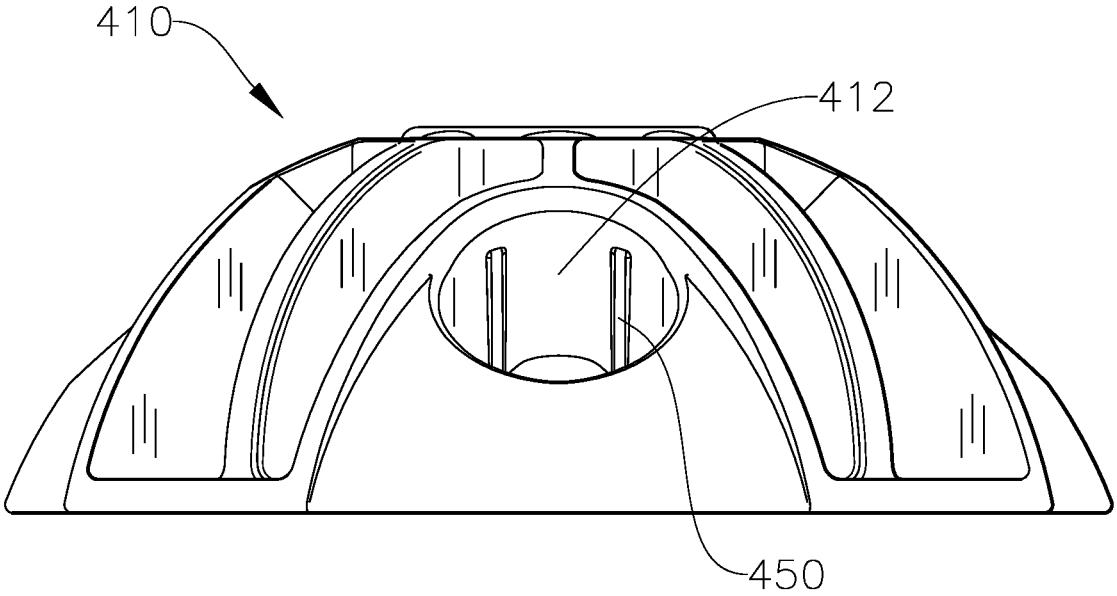
FIG. 27 is a side elevational view of a four-point hemispherical hub piece, in accordance with an embodiment of the present invention.
Figure 28:
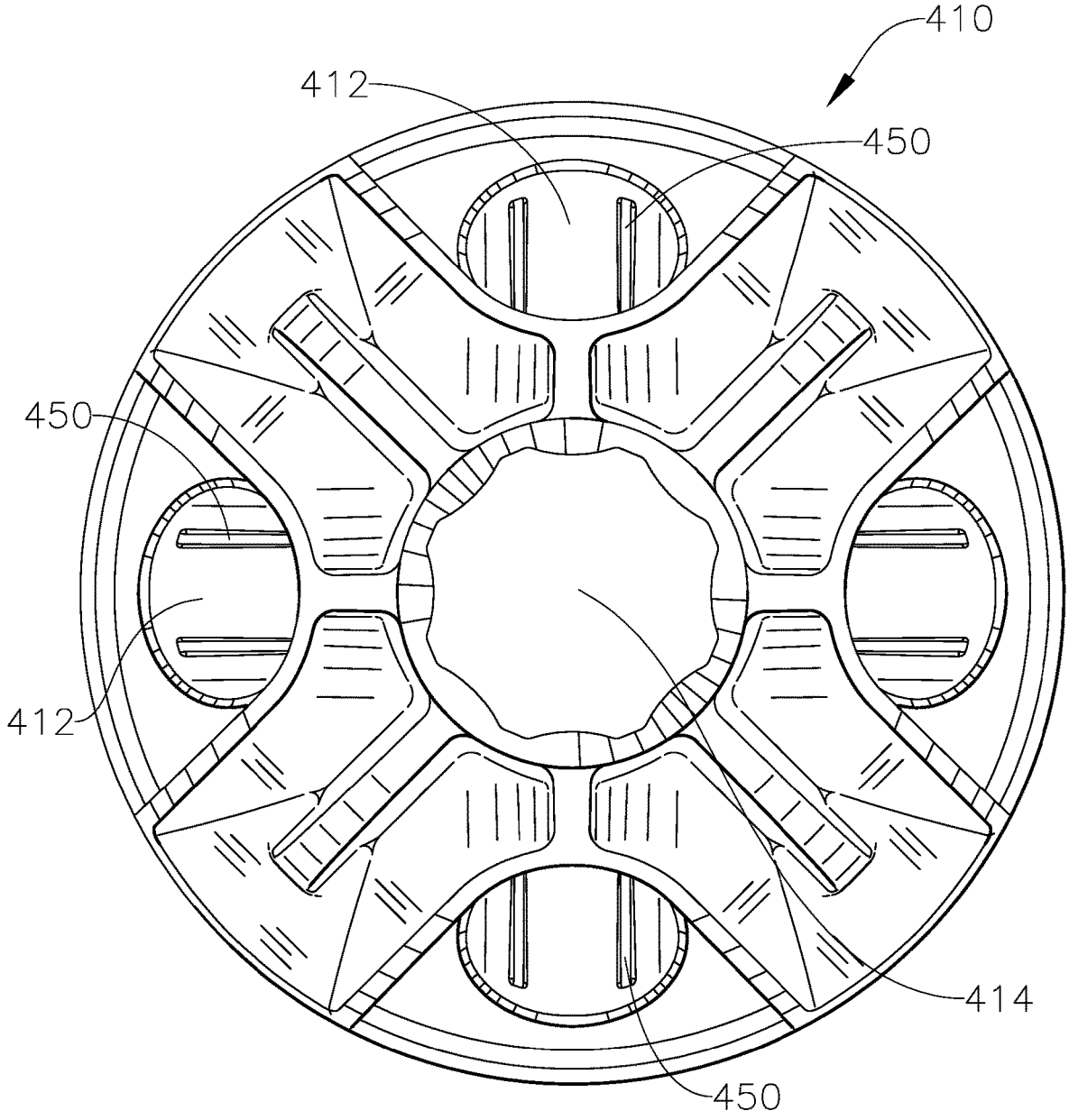
FIG. 28 is a top view of a four-point hemispherical hub piece, in accordance with an embodiment of the present invention.
Figure 29:
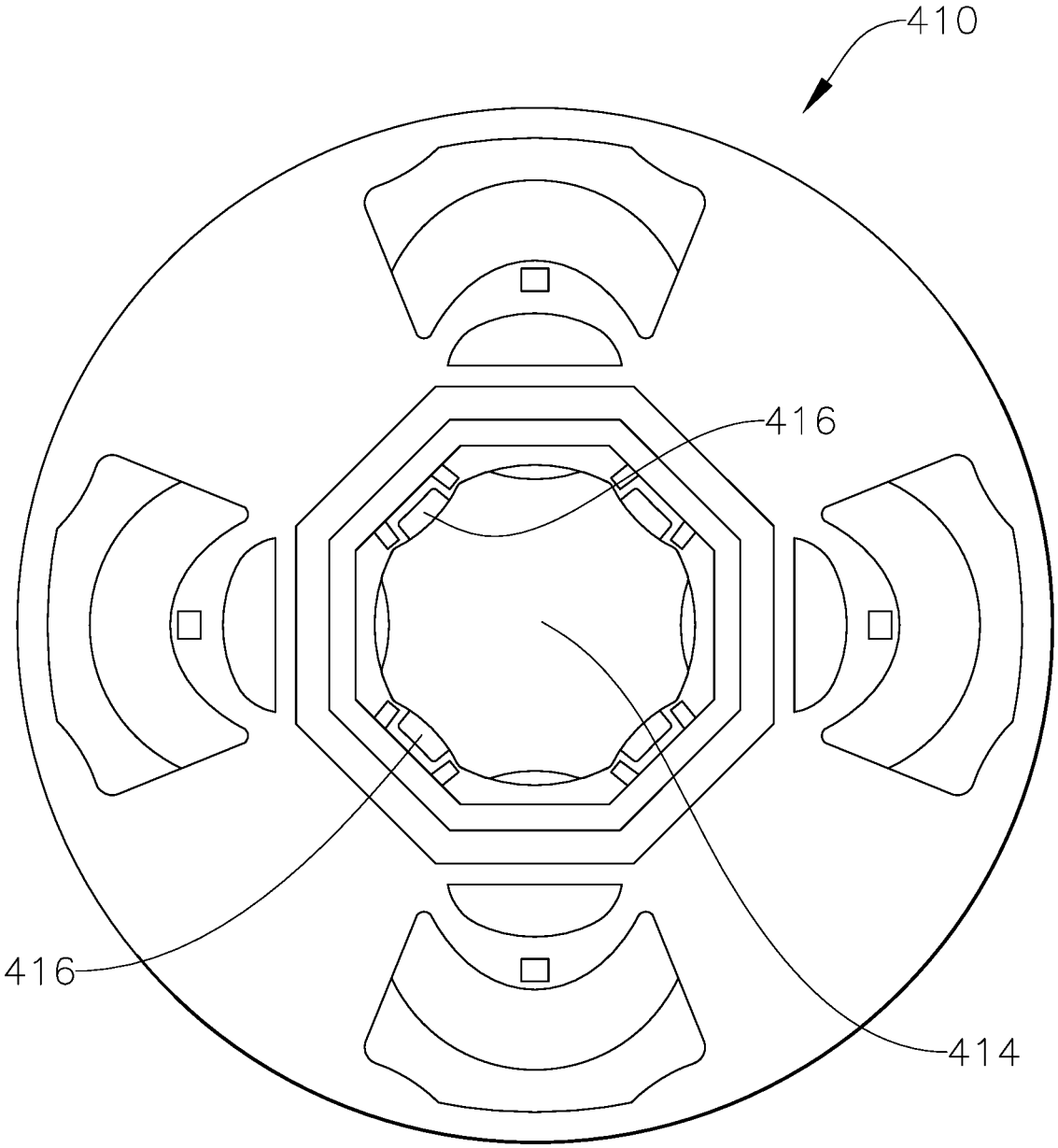
FIG. 29 is a bottom view of a four-point hemispherical hub piece, in accordance with an embodiment of the present invention.
Figure 30:
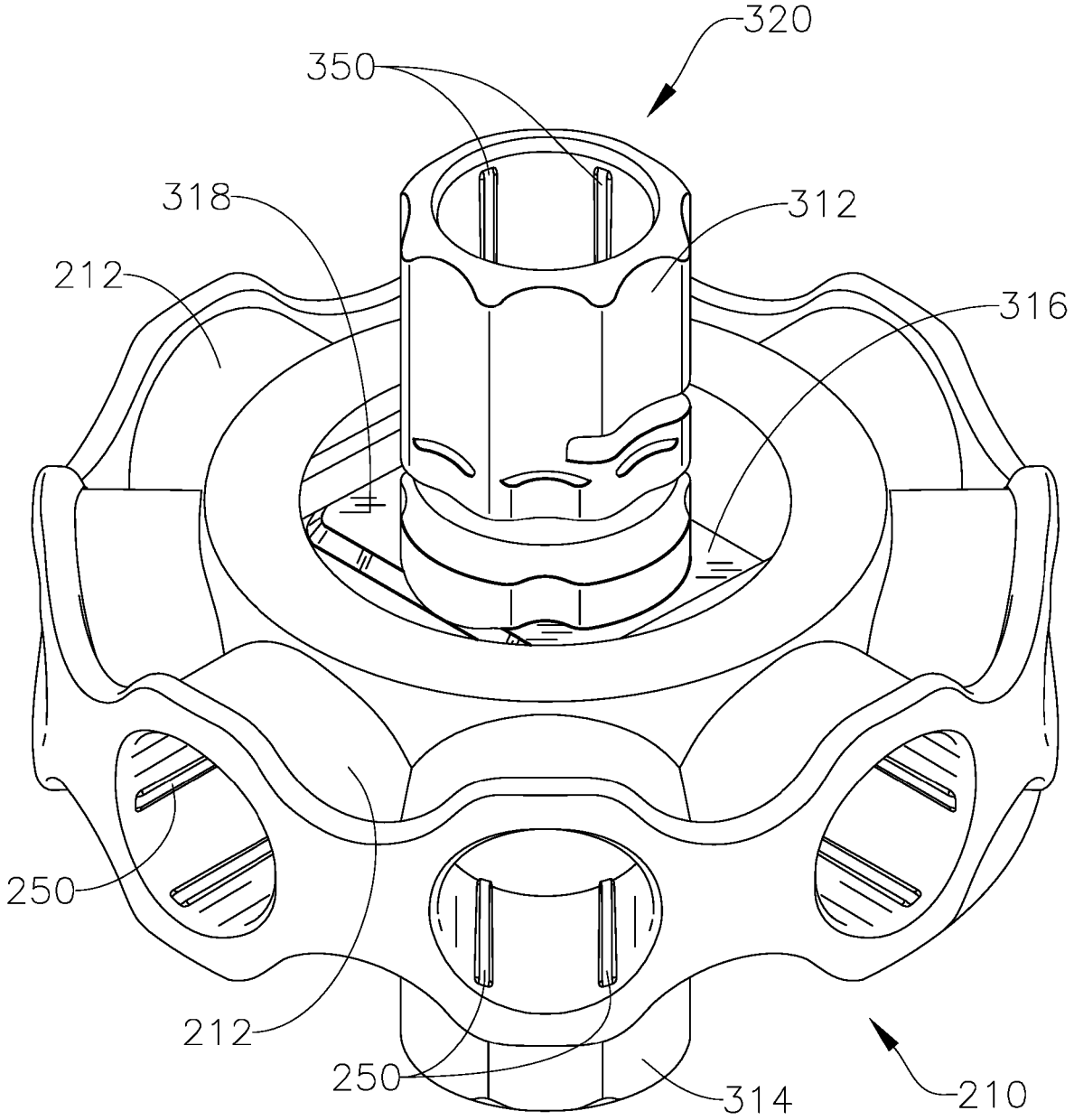
FIG. 30 is a top perspective view of a composite structure in accordance with an embodiment of the present invention.

FIGS. 23-25 show a two-point connector hub 310. In an embodiment, hub 310 is cylindrical in shape and has a pair of end ports 312, 314 which can receive pole connectors. The end ports 312, 314 can be dead end, or they can be interconnected. Extending from approximately the center of connector 310 is a pair of tabs 316. Each tab 316 has a pair of slots 318. In an embodiment of the present invention, two-point connector hub 310 is configured to dock inside central opening 214 of connector 210. In an unlocked configuration, tabs 316 sit on neck 218, which functions to prevent connector hub 310 from falling through connector hub 210. Connector 310 can then be locked into place within central opening 214 by rotating two-point connector hub 310 clockwise or anti-clockwise such that tabs 316 are in close proximity to grooved walls 220. When locked in place, connector 310 will be prevented from falling out in either direction by shelf 216 in one direction and neck 218 in the other. This first compound structure 320 can be seen in FIG. 30.

In some embodiments, slots 318 may interact with grooved walls 220 to secure the relative positions of connector hubs 210, 310. In further embodiments, preferred directions of rotation can be established via stops 222 on hub 210, which operate as impediments that prevent the rotation of connector hub 310 by catching tabs 316. For instance, stops 222 can prevent clockwise or anticlockwise rotation beyond the intended locked and unlocked configurations. Numerous other mechanical means for securing locked and unlocked positions can be implemented, beyond the enumerated examples. For an improved friction fit, fingers 350 can be provided on the inner walls of ports 312, 314.

In an embodiment two-point hub 310 can be provided with a window 322. This window can provide a user with visibility into the interior of two-point hub 310. This could be useful, for instance, to allow a user to see if an inserted pole (not shown) is fully inserted in end ports 312. Alternatively, window 322 can be gripped by spring fingers or mechanisms provided on another part to be connected to two-point hub 310 (e.g., when connected to the four-point hub described below). Another adaptation of two-point hub 310 to better interface with another part having fingers is the provision of a recessed area 324 on the exterior of two-point hub 310. A connecting mechanism can naturally occupy this space for a better fit and easier removal of connected parts.

When connector hubs 210 and 310 are in a locked position, the resulting compound structure 320 has the benefit of both lateral ports 212 and end ports 312, 314 perpendicular thereto. This exemplary compound hub structure therefore offers a total of ten different directions that connector poles can be extended from and lodged in.

FIGS. 26-29 show an additional, four-point connector hub 410 that can be provided, which can operate as an adapter. Hub 410 has angled ports 412 and a generally hemispherical shape. Connector 410 has a channel 414 passing therethrough. In isolation, connector hub 410 can be used to enable four different orientations of connector poles. In certain embodiments, channel 414 can receive a pole, providing a fifth port. For an improved friction fit, fingers 450 can be provided on the inner walls of ports 412 and/or 414. Particularly, spring fingers 416 in channel 414 can facilitate connection with two-point hub 310 by gripping recessed area 324.

Figure 31:
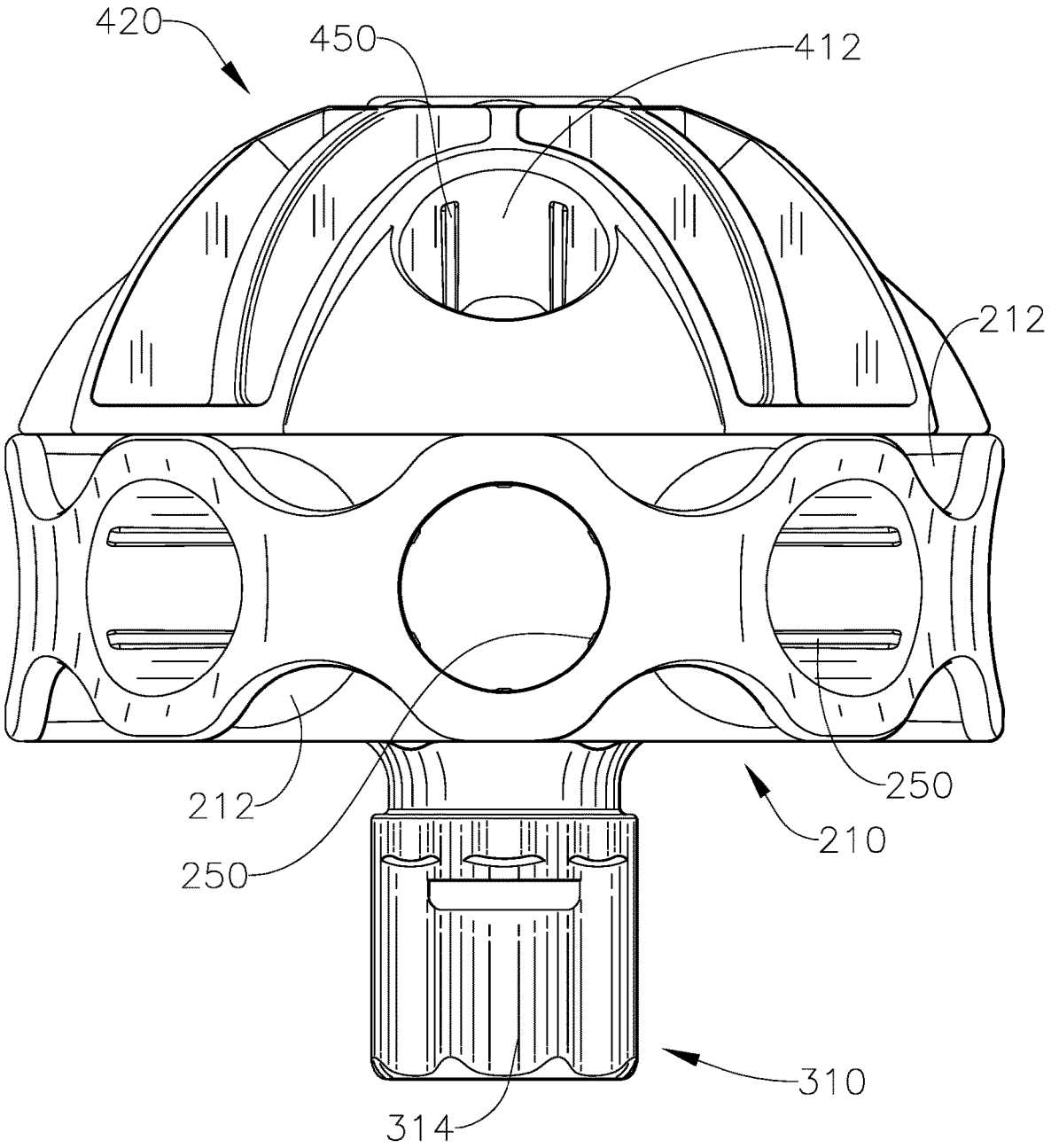
FIG. 31 is a front elevational view of a different composite structure, in accordance with an embodiment of the present invention.

In one embodiment, channel 414 can allow for an end port 312 of connector hub 310 to pass therethrough, forming an intermediate compound structure (not shown). The intermediate compound structure can be configured such that port 312 can still receive a pole connector while in such a configuration. Various modifications (e.g., ridges, slots, grooves, depressions, etc.) can be provided on connectors 310, 410 to resist relative moment therebetween or to otherwise secure connectors 310, 410 together; though in some embodiments, rotation of connector 410 about connector 310 may be desirable. In combination with connector 310, connector 410 effectively gains ports 312, 314 in addition to angled ports 412. Furthermore, while connected to connector 410, connector 310 can further interface with connector 210 as described hereinabove, forming a second compound structure 420 (see FIG. 31). Such a configuration would result in the provision of lateral ports 212 (i.e., eight more ports) to the compound structure hub 420.

Figure 32:
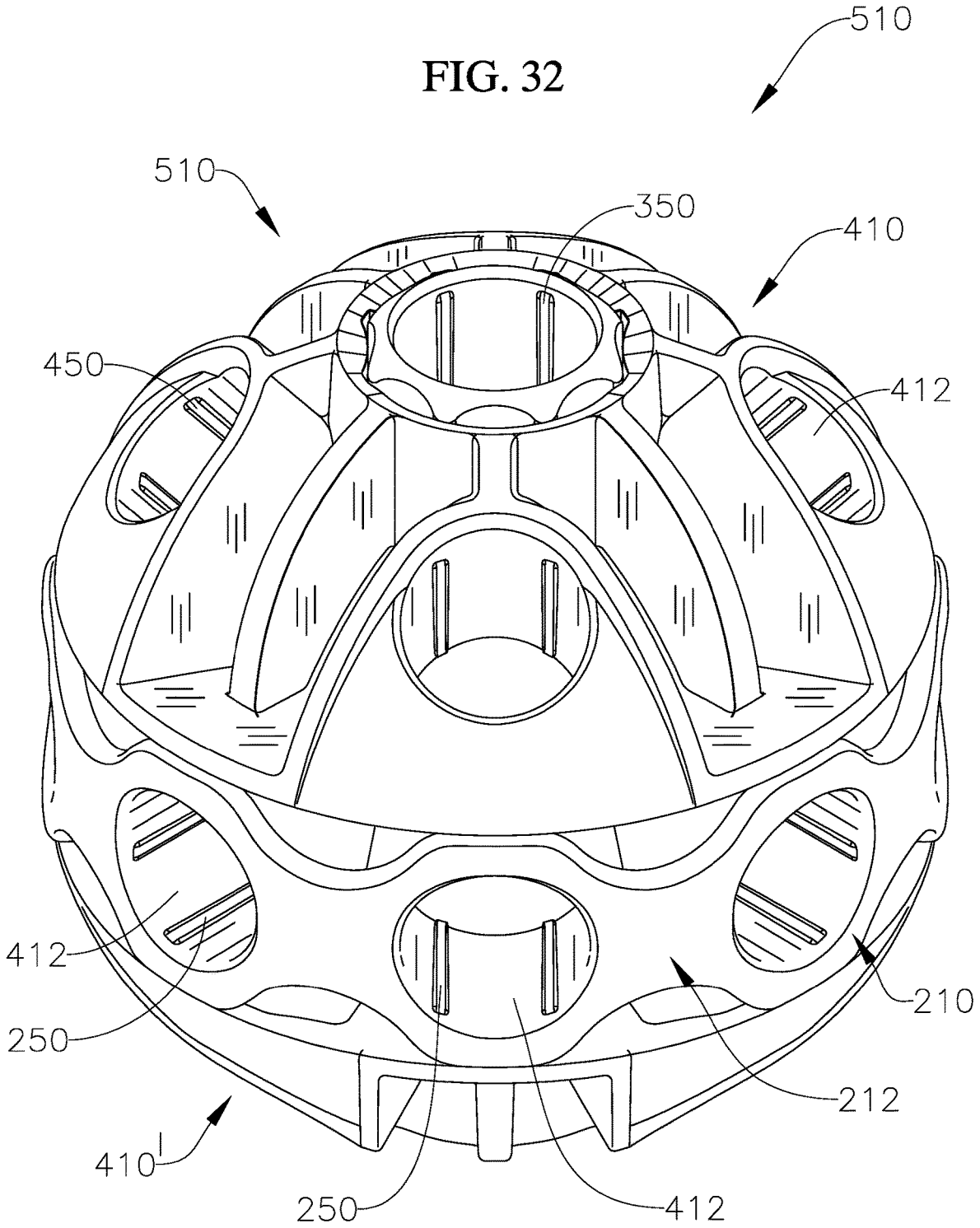
FIG. 32 is a top perspective view of a composite ball structure, in accordance with an embodiment of the present invention.

To maximize interconnective possibilities, another hemispherical connector hub 410' can be added to structure 420. This would be implemented by receiving the other port 314, in channel 410' of the second hemispherical connector 410'. The resulting ball-shaped compound connector hub 510 (see FIG. 32) therefore has a total of sixteen (or in some embodiments, eighteen) different ports and directions in which it can receive a pole connector. In certain embodiments, angled ports 412' can be symmetrical with respect to angled ports 412. Alternatively, angled ports 412 can be anti-symmetrical with respect to angled ports 412', which would offer further customizability in terms of possible connections and constructed structures. In alternate embodiments, connector 210 can be omitted from connector hub 510, resulting in a third compound structure (not shown) of connector hubs 310, 410 and 410' that lacks lateral ports 212.

In certain embodiments, connector hub 410 can be positioned on connector hub 310 in eight different positions (e.g., by rotating connector hub 410 in 45 degree increments). Implemented as such, the compound structures involving hubs 310, 410 would therefore be able to provide additional angles. In an embodiment, by rotating hemispherical connector 410 and/or hemispherical connector 410', up to eight alternate angles could be achieved for a total of twenty-six possible orientations.

It will be understood that the embodiments described herein are merely exemplary and that a person skilled in the art may make many variations and modifications without departing from the spirit and scope of the invention. All such variations and modifications are intended to be included within the scope of the invention.

The invention claimed is:

1. A toy fort structure building kit including poles and an interconnection configured for receiving the poles, the interconnection comprising:

a ring-shaped hub having a lumen passing therethrough and a first plurality of ports disposed along an outer circumference of said ring-shaped hub;

a first multi-point hub piece having a cylindrical body and a plurality of tabs extending colinearly from a central section, said first multi-point hub piece being configured to fit into said lumen, and said first multi-point hub piece being lockable with said ring-shaped hub by interfacing with said lumen, wherein said cylindrical body includes a top port at one end of said cylindrical body, and a bottom port at another end of said cylindrical body, opposite said top port; and a second multi-point hub piece having an outer surface having a second plurality of ports oriented away from said outer surface and a central port, said central port being adapted to receive said top port or said bottom port.

2. The kit of claim 1, wherein said first plurality of ports consists of eight ports.

3. The kit of claim 1, wherein said lumen is centrally placed in said ring-shaped hub.

4. The kit of claim 1, wherein said first plurality of ports include dead-end geometries.

5. The kit of claim 1, wherein said first multi-point hub piece has a cylindrical body.

6. The kit of claim 1, further comprising a two point hub piece, wherein said two-point hub piece and said first multi-point hub piece are configured to become interlocked to form a composite structure.

7. The kit of claim 6, wherein said ring-shaped hub piece further comprises a shelf coupled to said ring shaped-hub piece and located at one end of said lumen, said shelf having a slot with a narrower diameter than the diameter of said lumen.

8. The kit of claim 7, wherein said composite structure is formed when said tabs are engaged with said shelf.

9. The kit of claim 8, wherein said first multi-point hub piece is rotatable while in said lumen of said ring-shaped hub such that said first multi-point hub piece can be selectively locked and unlocked into place within said lumen through clockwise and/or anticlockwise rotation, whereby said tabs can be selectively engaged or disengaged with said shelf.

10. The kit of claim 1, wherein said second plurality of ports include dead-end geometries.

11. The kit of claim 1, wherein said second multi-point hub piece is hemispherical in shape.

12. The kit of claim 11, wherein said composite structure can receive said second multi-point hub piece at said top port and said bottom port simultaneously, thereby forming a ball structure.

13. The kit of claim 12, wherein said ball structure has a total of sixteen different ports.

14. The kit of claim 1, wherein said second plurality of ports consists of four ports.

15. The kit of claim 14, wherein each port of said second plurality of ports is angled away from a top surface of said second multi-point hub piece.

16. The kit of claim 15, wherein said second multi-point hub piece includes teeth within said central port, said teeth adapted to interface with a recess localized on said first multi-point hub piece.

17. The kit of claim 1, further comprising a flexible hub piece which includes a plurality of flexible ports.

18. The kit of claim 17, wherein said plurality of flexible ports consists of five or six ports.

* * * * *